US009316931B2

(12) United States Patent
Takagi et al.

(10) Patent No.: US 9,316,931 B2
(45) Date of Patent: Apr. 19, 2016

(54) ELECTROPHOTOGRAPHIC PHOTOSENSITIVE MEMBER, ELECTROPHOTOGRAPHIC APPARATUS, PROCESS CARTRIDGE, AND CONDENSED POLYCYCLIC AROMATIC COMPOUND

(71) Applicant: CANON KABUSHIKI KAISHA, Tokyo (JP)

(72) Inventors: Shinji Takagi, Yokohama (JP); Koichi Nakata, Kashiwa (JP); Nobuo Kosaka, Gotemba (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/191,413

(22) Filed: Feb. 26, 2014

(65) Prior Publication Data

US 2014/0255836 A1 Sep. 11, 2014

(30) Foreign Application Priority Data

Mar. 7, 2013 (JP) ..... 2013-045698
Feb. 21, 2014 (JP) ..... 2014-032154

(51) Int. Cl.
*G03G 5/147* (2006.01)
*G03G 5/06* (2006.01)
*G03G 21/18* (2006.01)

(52) U.S. Cl.
CPC ..... *G03G 5/0607* (2013.01); *G03G 5/0605* (2013.01); *G03G 5/0609* (2013.01); *G03G 5/0629* (2013.01); *G03G 5/14708* (2013.01); *G03G 21/1803* (2013.01)

(58) Field of Classification Search
CPC ..... G03G 5/0517; G03G 7/0026
See application file for complete search history.

(56) References Cited

U.S. PATENT DOCUMENTS

| | | | | |
|---|---|---|---|---|
| 3,865,798 | A * | 2/1975 | Radler et al. | 526/75 |
| 3,867,140 | A * | 2/1975 | Hashimoto | 430/83 |
| 4,022,956 | A * | 5/1977 | Bergfjord et al. | 526/75 |
| 4,424,223 | A * | 1/1984 | Keve et al. | 514/283 |
| 5,665,500 | A | 9/1997 | Suzuki | |
| 2004/0137346 | A1 | 7/2004 | Lee et al. | |

(Continued)

FOREIGN PATENT DOCUMENTS

| | | | | |
|---|---|---|---|---|
| EP | 2 680 079 | A1 | 1/2014 | |
| GB | 2071084 | * | 9/1981 | C07C 49/573 |

(Continued)

OTHER PUBLICATIONS

European Search Report dated Nov. 24, 2014 in European Application No. 14000813.7.

(Continued)

*Primary Examiner* — Hoa V Le
(74) *Attorney, Agent, or Firm* — Fitzpatrick, Cella, Harper and Scinto

(57) ABSTRACT

A surface layer of an electrophotographic photosensitive member contains a polymerized product obtained by a polymerization reaction of a hole transporting compound having a first reactive functional group and a compound having a second reactive functional group reactable with the first reactive functional group, and a structure other than the first reactive functional group of the hole transporting compound is a structure having only a carbon atom and a hydrogen atom, or a structure having only a carbon atom, a hydrogen atom and an oxygen atom.

4 Claims, 1 Drawing Sheet

(56) References Cited

U.S. PATENT DOCUMENTS

| | | | | |
|---|---|---|---|---|
| 2008/0096123 | A1* | 4/2008 | Shimada et al. | 430/127 |
| 2009/0004583 | A1 | 1/2009 | Nukada et al. | |
| 2011/0171570 | A1 | 7/2011 | Takimoto et al. | |

FOREIGN PATENT DOCUMENTS

| | | | | |
|---|---|---|---|---|
| GB | 2125031 | * | 2/1984 | C07C 69/757 |
| JP | 8-272126 | A | 10/1996 | |
| JP | 2001-242656 | A | 9/2001 | |
| JP | 2010-211031 | A | 9/2010 | |

OTHER PUBLICATIONS

Mattiello, et al., "Electrochemistry of 9,9'-Spirobifluorene Derivatives: 2-Acetyl- and 2,2'-Diacety1- 9,9'-Spirobifluorene. Preparation of Stereoisomeric 2,3-bis(9,9'-Spirobi¬ fluoren-2-yl)butane-2,3-diols", J. Chem. Society, Perkin Transactions 2, No. 11, 1993, pp. 2243-2247.

Profft, et al., "Uber die Hydroxy•thylierung mehrkerniger Aromaten und einige Abwandlungsprodukte des 2-[2'-Hydroxy•hyl]-fluorens", Journal Fur Praktische Chemie, vol. 4, No. 22, 1963, pp. 47-58.

Nakata, et al., U.S. Appl. No. 14/191,414, filed Feb. 26, 2014.

* cited by examiner

ELECTROPHOTOGRAPHIC PHOTOSENSITIVE MEMBER, ELECTROPHOTOGRAPHIC APPARATUS, PROCESS CARTRIDGE, AND CONDENSED POLYCYCLIC AROMATIC COMPOUND

BACKGROUND OF THE INVENTION

1. Field of the Invention

The present invention relates to an electrophotographic photosensitive member, and an electrophotographic apparatus and a process cartridge including the electrophotographic photosensitive member. The present invention also relates to a novel condensed polycyclic aromatic compound.

2. Description of the Related Art

For the purpose of enhancing durability of an electrophotographic photosensitive member containing an organic photoconductive substance, there is a technique for providing a protective layer on a photosensitive layer of the electrophotographic photosensitive member.

Japanese Patent Application Laid-Open No. 2010-211031 describes that the outermost surface layer of an electrophotographic photosensitive member contains a polymerized product of a composition including a melamine compound, and a charge transporting compound having a group represented by —OH, —$OCH_3$, —$NH_2$, —SH or —COOH.

However, if durability of the electrophotographic photosensitive member is thus increased, image deletion and potential change tend to occur. Image deletion is considered to be caused as follows: a material in a surface layer of the electrophotographic photosensitive member is degraded due to ozone, nitrogen oxide and the like generated by charging of the electrophotographic photosensitive member, and moisture is adsorbed to the surface of the electrophotographic photosensitive member to reduce the surface resistance of the surface layer. Image deletion tends to remarkably occur particularly under a high-temperature and high-humidity environment.

On the other hand, Japanese Patent Application Laid-Open No. H08-272126 and Japanese Patent Application Laid-Open No. 2001-242656 describe that a specified additive is contained in an electrophotographic photosensitive member to thereby improve permeability to gas, ozone resistance and image density change of the electrophotographic photosensitive member.

Recently, ruggedization of an electrophotographic photosensitive member has remarkably progressed, and image deletion and potential change have been demanded to be further improved.

SUMMARY OF THE INVENTION

The present invention is directed to providing an electrophotographic photosensitive member high in wear resistance, and also excellent in suppression of image deletion and potential change, as well as an electrophotographic apparatus and a process cartridge including the electrophotographic photosensitive member. Further, the present invention is directed to providing a condensed polycyclic aromatic compound capable of suppressing image deletion and potential change.

According to one aspect of the present invention, there is provided an electrophotographic photosensitive member comprising a support and a photosensitive layer formed on the support, wherein a surface layer of the electrophotographic photosensitive member containing a polymerized product of a composition including a hole transporting compound having a first reactive functional group and a compound having a second reactive functional group reactable with the first reactive functional group, and a structure other than the first reactive functional group of the hole transporting compound is a structure having only a carbon atom and a hydrogen atom, or a structure having only a carbon atom, a hydrogen atom and an oxygen atom.

According to another aspect of the present invention, there is provided a process cartridge which integrally supports the electrophotographic photosensitive member, and at least one unit selected from the group consisting of a charging unit, a developing unit, a transferring unit and a cleaning unit, wherein the process cartridge is detachably attachable to a main body of an electrophotographic apparatus.

According to further aspect of the present invention, there is provided an electrophotographic apparatus comprising the electrophotographic photosensitive member, and a charging unit, an exposing unit, a developing unit and a transferring unit.

According to further another aspect of the present invention, there is provided a condensed polycyclic aromatic compound having a first reactive functional group, wherein a structure other than the first reactive functional group of the condensed polycyclic aromatic compound is a structure having only a carbon atom and a hydrogen atom, or a structure having only a carbon atom, a hydrogen atom and an oxygen atom, and the first reactive functional group is a hydroxy group, a methoxy group, a carboxy group, an amino group or a thiol group.

According to the present invention, an electrophotographic photosensitive member having high in wear resistance, and also excellent in suppression of image deletion and potential change, as well as a process cartridge and an electrophotographic apparatus including the electrophotographic photosensitive member can be obtained. Furthermore, according to the present invention, a condensed polycyclic aromatic compound capable of suppressing image deletion and potential change can be obtained.

Further features of the present invention will become apparent from the following description of exemplary embodiments with reference to the attached drawings.

DESCRIPTION OF THE EMBODIMENTS

Figure 1:
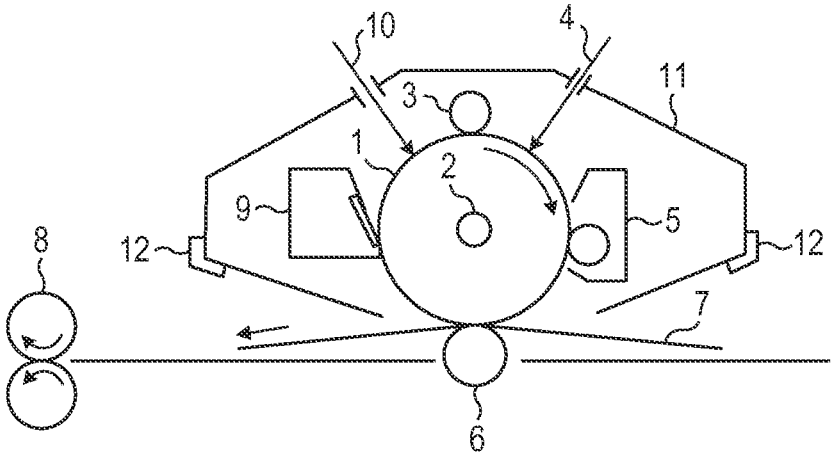
FIG. 1 is a view illustrating one example of a schematic configuration of an electrophotographic apparatus provided with a process cartridge including an electrophotographic photosensitive member.

Preferred embodiments of the present invention will now be described in detail in accordance with the accompanying drawings.

In the present invention, a surface layer of an electrophotographic photosensitive member contains a polymerized product of a composition including a hole transporting compound having a first reactive functional group and a compound having a second reactive functional group reactable with the first reactive functional group. Furthermore, a structure other than the first reactive functional group of the hole transporting compound is a structure having only a carbon atom and a hydrogen atom, or a structure having only a carbon atom, a hydrogen atom and an oxygen atom.

The present inventors think that image deletion is caused partially due to chemical alternation of an amine structure in a hole transporting compound contained in a surface layer of a usual electrophotographic photosensitive member. Then, the present inventors have searched a hole transporting compound for electrophotographic photosensitive members free from an amine structure, leading to the present invention.

As a hole transporting compound for use in an electrophotographic photosensitive member, an amine compound, in particular, an arylamine compound is most frequently used in order to allow holes to be efficiently injected and conveyed. It is considered that hole transporting properties of the arylamine compound is exhibited by electron donating properties of an amine structure and interaction of a nitrogen atom with an aryl group or a group consisting of carbon atoms having sp2 electron orbital (hereinafter, also referred to as sp2 carbon atoms) around the nitrogen atom. It is considered that an arylamine structure tends to undergo a chemical reaction and the like because of being excellent in hole donating/accepting ability. It is considered that particularly in the process of charging on the surface of an electrophotographic photosensitive member, the arylamine structure tends to undergo degradation such as oxidation by the action of an oxidized gas generated by charging, such as ozone and nitrogen oxide.

In addition, the arylamine structure is oxidized to result in the increase in polar group on a surface member, thereby allowing a discharge product to be easily attached. As a result, it is considered that the discharge product is attached particularly in a high-temperature and high-humidity environment to cause the reduction in the surface resistance of the surface layer and thus the occurrence of image deletion.

It is also considered that the occurrence of an electron transfer reaction of nitrogen oxide with the amine compound allows an ion pair to be formed, to thereby reduce the surface resistance of the surface layer, easily causing image deletion.

The present inventors have intensively studied, and as a result, have found that a polymerized product of a composition including the hole transporting compound of the present invention is used to thereby exert the excellent effects of increasing wear resistance and suppressing image deletion and potential change. The reason for this is because the hole transporting compound of the present invention includes no arylamine structure, specifically includes no nitrogen atom, and thus the hole transporting compound is less easily oxidized than an arylamine compound.

In the hole transporting compound of the present invention, the structure other than the first reactive functional group preferably has a conjugate structure having 24 or more sp2 carbon atoms, further preferably 28 or more sp2 carbon atoms, from the viewpoint of hole transporting properties. The conjugate structure means a structure in which sp2 carbon atoms are continuously bonded. The conjugate structure has the property of promoting the delocalization of electrons in a molecule, easily performing charge donating/accepting between molecules.

From the viewpoints of film formability, compatibility with a material for forming the surface layer, film strength and the like, the number of sp2 carbon atoms is 120 or less, and more preferably 60 or less.

In the hole transporting compound of the present invention, the conjugate structure can have a condensed polycyclic structure therein. The condensed polycyclic structure means a structure in which 2 or more cyclic structures such as benzene rings are adjacent to each other.

The condensed polycyclic structure can be a condensed polycyclic structure in which the number of sp2 carbon atoms is 12 or more. In order to further exert hole transporting properties, the number of sp2 carbon atoms for forming the condensed polycyclic structure is preferably 14 or more, and more preferably 16 or more.

The number of sp2 carbon atoms for forming the condensed polycyclic structure is preferably 20 or less and more preferably 18 or less from the viewpoints of film formability and compatibility with a material for constituting the surface layer.

With respect to a ring structure for forming the condensed polycyclic structure, the conjugate structure can be planarly extended. Accordingly, in order to form a planar structure, the condensed polycyclic structure can have a 5-membered ring or a 6-membered ring. While the number of rings for forming the condensed polycyclic structure is 2 or more, the number can be 3 or more in order to more suitably exert hole transporting properties.

In addition, the ring structure for forming the condensed polycyclic structure preferably has 6 or less rings and more preferably 5 or less rings from the viewpoints of film formation ability and flexibility of a molecule. That is, a condensed polycyclic structure having 3 rings or 4 rings is most preferable.

The hole transporting compound of the present invention can have at least one unit (one) of the condensed polycyclic structures as a partial structure. From the viewpoint of further exerting hole transporting properties, the hole transporting compound preferably has two or more units of the condensed polycyclic structures, more preferably 3 units or more of the condensed polycyclic structures. In addition, a hole transport substance preferably has 10 units or less of the condensed polycyclic structures, more preferably 4 units or less of the condensed polycyclic structures in one molecule.

When the hole transport substance has 2 or more of the condensed polycyclic structures, the hole transport substance can have a structure, in which the condensed polycyclic structures are connected to each other by a single bond (the condensed polycyclic structures are directly connected to each other), from the viewpoint of stability against chemical alteration.

In addition, the condensed polycyclic structure is preferably fluorene, anthracene, phenanthrene, fluoranthene or pyrene because the effects of hole transporting properties and suppression of image deletion are higher. The condensed polycyclic structure is more preferably fluorene or pyrene. Such a condensed polycyclic structure may have a substituent.

Herein, the number of sp2 carbon atoms in the hole transport substance of the present invention does not include the number of sp2 carbon atoms included in the first reactive functional group.

The first reactive functional group includes a hydroxy group, an alkoxy group, a carboxy group, an amino group and a thiol group. In particular, a hydroxy group, a methoxy group, a carboxy group, an amino group and a thiol group are preferable. A hydroxy group is further preferable.

A compound in which the first reactive functional group of the hole transporting compound of the present invention is replaced with a hydrogen atom can be represented by the following formula (1).

The molecular structure of the hole transport substance of the present invention can be roughly classified to a structure of the first reactive functional group and a structure other than the first reactive functional group. The structure of the first reactive functional group is, for example, the above-exemplified structure of the first reactive functional group. The structure other than the first reactive functional group means a structure in which the structure of the first reactive functional group is subtracted from the molecular structure of the hole transport substance. Herein, when the structure of the first reactive functional group is simply subtracted from the molecular structure of the hole transport substance, a covalent bond remains in a linkage portion of the structure of the first reactive functional group and the structure other than the first reactive functional group. A structure in which a hydrogen atom is bonded to the remaining covalent bond means the compound in which the first reactive functional group is replaced with a hydrogen atom.

(1)

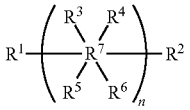

In the formula (1), $R^1$ to $R^6$ each independently represent a hydrogen atom, a substituted or unsubstituted alkyl group, a substituted or unsubstituted aralkyl group, or a substituted or unsubstituted aryl group, $R^7$ represents a group derived from a substituted or unsubstituted arene by loss of 6 hydrogen atoms, and n represents an integer of 1 to 10, provided that when n represents 2 to 10, partial structures represented by the following formula (2) in the formula (1) may be the same or different.

(2)

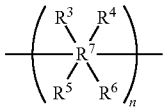

The alkyl group includes a methyl group, an ethyl group, a n-propyl group, an isopropyl group, a n-butyl group, an isobutyl group, a sec-butyl group, a tert-butyl group, a n-pentyl group, an isopentyl group, a neopentyl group, a tert-pentyl group, a cyclopentyl group, a n-hexyl group, a 1-methylpentyl group, a 4-methyl-2-pentyl group, a 3,3-dimethylbutyl group, a 2-ethylbutyl group, a cyclohexyl group, a 1-methylhexyl group, a cyclohexylmethyl group, a 4-tert-butylcyclohexyl group, a n-heptyl group, a cycloheptyl group, a n-octyl group, a cyclooctyl group, a tert-octyl group, a 1-methylheptyl group, a 2-ethylhexyl group, a 2-propylpentyl group, a n-nonyl group, a 2,2-dimethylheptyl group, a 2,6-dimethyl-4-heptyl group, a 3,5,5-trimethylhexyl group, a n-decyl group, a n-undecyl group, a 1-methyldecyl group, a n-dodecyl group, a n-tridecyl group, a 1-hexylheptyl group, a n-tetradecyl group, a n-pentadecyl group, a n-hexadecyl group, a n-heptadecyl group, a n-octadecyl group and a n-eicosyl group.

The aralkyl group includes a benzyl group, a phenethyl group, an α-methylbenzyl group, an α,α-dimethylbenzyl group, a 1-naphthylmethyl group, a 2-naphthylmethyl group, an anthracenylmethyl group, a phenanthrenylmethyl group, a pyrenylmethyl group, a furfuryl group, a 2-methylbenzyl group, a 3-methylbenzyl group, a 4-methylbenzyl group, a 4-ethylbenzyl group, a 4-isopropylbenzyl group, a 4-tert-butylbenzyl group, a 4-n-hexylbenzyl group, a 4-n-nonylbenzyl group, a 3,4-dimethylbenzyl group, a 3-methoxybenzyl group, a 4-methoxybenzyl group, a 4-ethoxybenzyl group, a 4-n-butyloxybenzyl group, a 4-n-hexyloxybenzyl group and a 4-n-nonyloxybenzyl group.

The aryl group includes a phenyl group, a biphenylyl group, a naphthyl group, a fluorenyl group, an anthracenyl group, a phenanthrenyl group, a fluoranthenyl group, a pyrenyl group, a triphenylenyl group, a monovalent group derived from tetracene, a monovalent group derived from chrysene, a monovalent group derived from pentacene, a monovalent group derived from acenaphthene, an acenaphthylenyl group, a monovalent group derived from perylene, a monovalent group derived from corannulene and a monovalent group derived from coronene. Furthermore, the aryl group may be a compound having a structure in which such condensed polycyclic structures having a conjugate structure are linked directly or via a conjugate double bond group.

$R^7$ represents a group in which 6 hydrogen atoms are removed from a substituted or unsubstituted arene. As the arene structure in $R^7$, in addition to a benzene ring, an arene in which a plurality of rings are further linked can be applied. Among such arene structures, a polycyclic structure having a conjugate structure and having a planar structure can be applied, as described above. The arene structure can be a benzene structure, a naphthalene structure, a fluorene structure, an anthracene structure, a phenanthrene structure, a fluoranthene structure, a pyrene structure, a triphenylene structure, a tetracene structure, a chrysene structure, a pentacene structure, an acenaphthene structure, an acenaphthylene structure, a perylene structure, a corannulene structure or a coronene structure. Furthermore, the arene structure may be a structure in which such arenes are linked to each other directly or via a conjugate double bond group. The arene structure can be in particular a fluorene structure, an anthracene structure, a phenanthrene structure, a fluoranthene structure or a pyrene structure.

At least one of $R^1$ to $R^7$ preferably represents the condensed polycyclic structure, and two or more of $R^1$ to $R^7$ further preferably represent the condensed polycyclic structure.

When n represents 2 or more, $R^7$ has a linked structure. Arene structures in $R^7$ in such a case may be connected to each other directly or via a carbon atom. Arene structures can be connected directly to each other.

The condensed polycyclic aromatic compound capable of suppressing image deletion and potential change includes the following compound. That is, a compound having a hydroxy group, a methoxy group, a carboxy group, an amino group or a thiol group, in which the hydroxy group, the methoxy group, the carboxy group, the amino group or the thiol group of the condensed polycyclic aromatic compound is replaced with a hydrogen atom, corresponds to the compound represented by the formula (1).

In the hole transport substance of the present invention, the substituent may be appropriately selected to thereby allow an sp3 carbon atom to be present in a proper proportion.

The hole transporting compound preferably has at least one of the first reactive functional group. The hole transporting compound further preferably has two to four reactive functional groups from the viewpoint of compactness of molecules in a film.

In the hole transporting compound of the present invention, the molecular weight of the compound represented by the formula (1) can be 300 or more and 3000 or less. When the molecular weight is in the above range, hole transporting properties and film uniformity are sufficiently achieved.

In the present invention, the condensed polycyclic aromatic compound capable of suppressing image deletion and potential change includes a compound characterized by the following: namely, the condensed polycyclic aromatic compound having the first reactive functional group, in which the structure other than the first reactive functional group of the condensed polycyclic aromatic compound is a structure having only a carbon atom and a hydrogen atom or a structure having only a carbon atom, a hydrogen atom and an oxygen atom, and additionally, in which the first reactive functional group is a hydroxy group, a methoxy group, a carboxy group, an amino group or a thiol group.

Specific examples of the hole transporting compound having the first reactive functional group of the present invention are shown below.

(I-1)

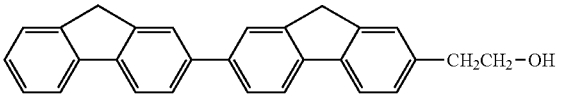

(I-2)

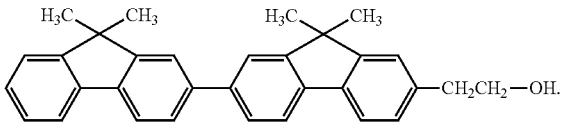

(I-3)

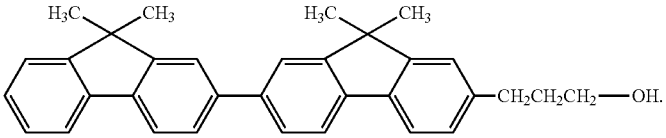

(I-4)

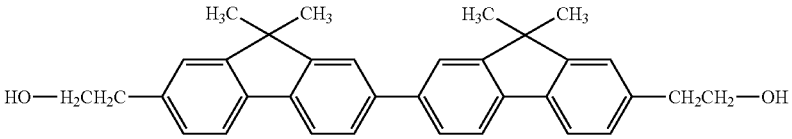

(I-5)

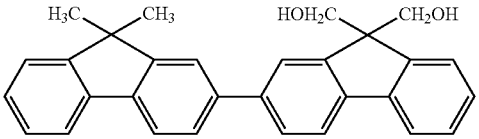

(I-6)

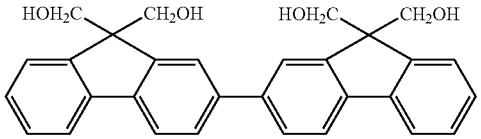

(I-7)

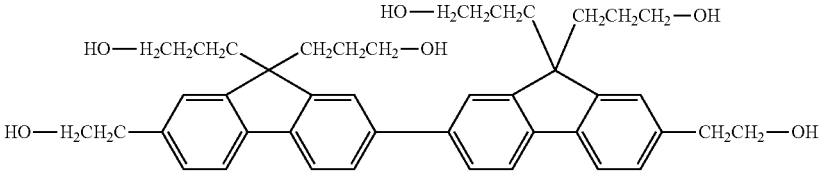

(I-8)

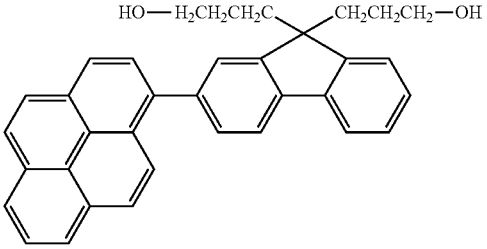

(I-9)

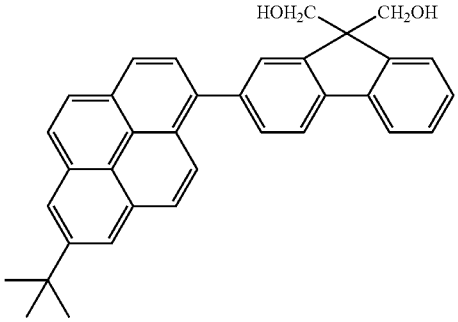

(I-10)

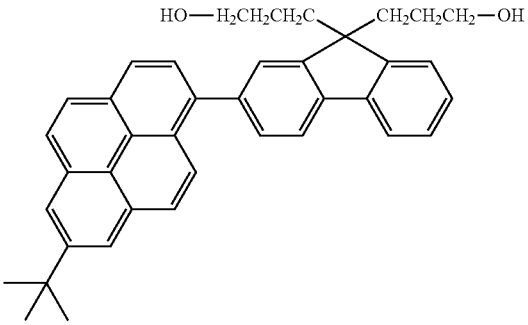

(I-11)

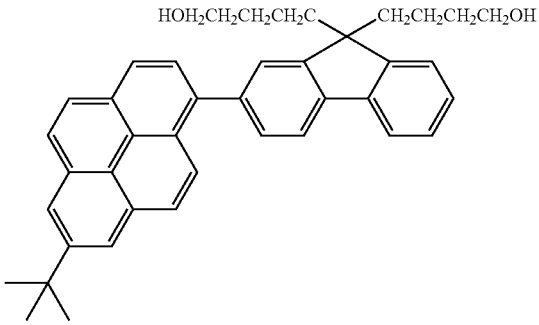

-continued
(I-12)
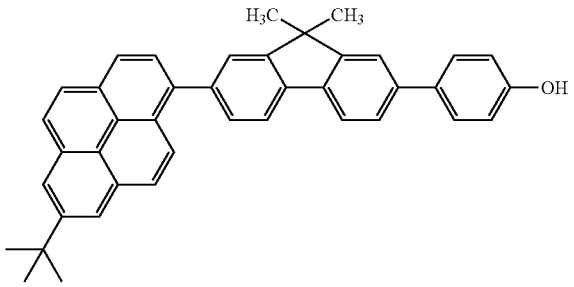
(I-13)
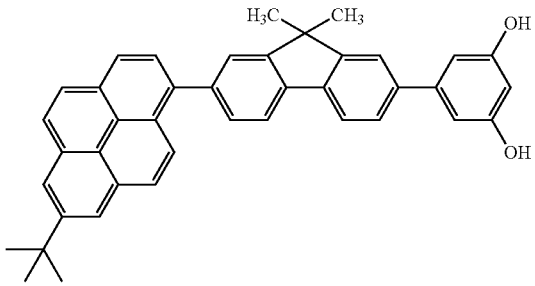
(I-14)
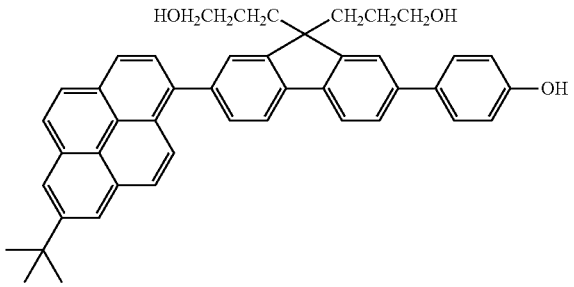
(I-15)
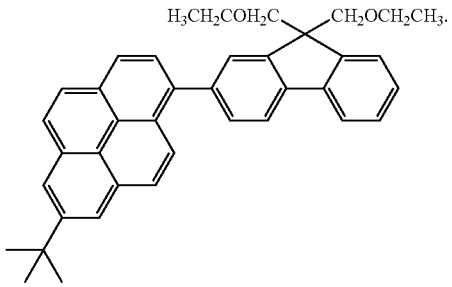
(I-16)
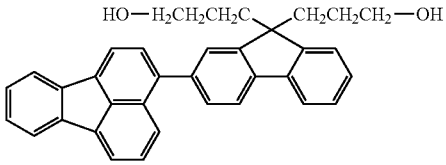
(I-17)
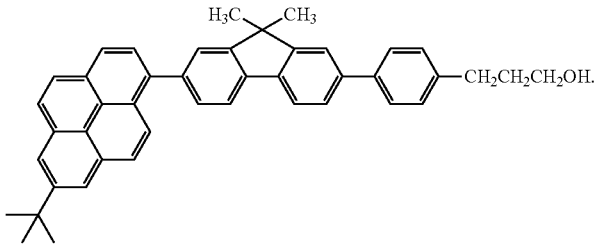
(I-18)
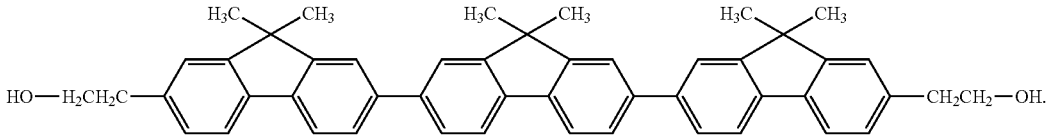
(I-19)
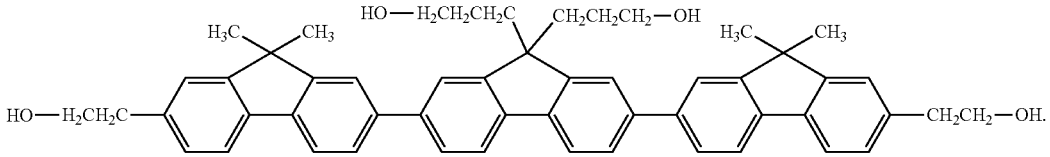
(I-20)
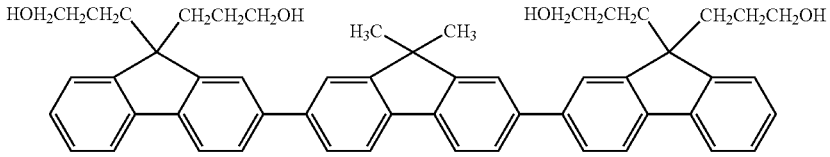
(I-21)
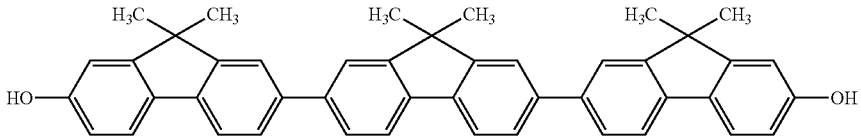

-continued
(I-22)
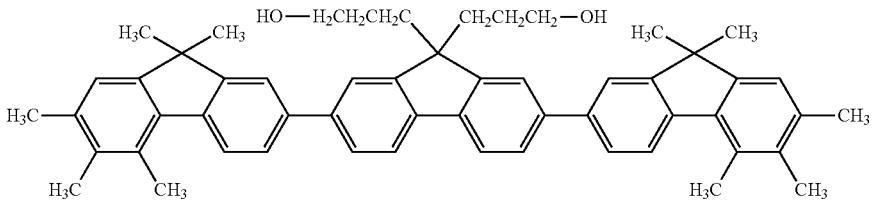
(I-23)
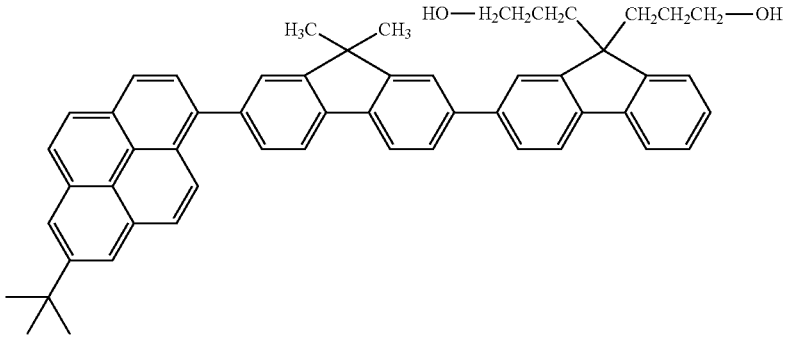
(I-24)
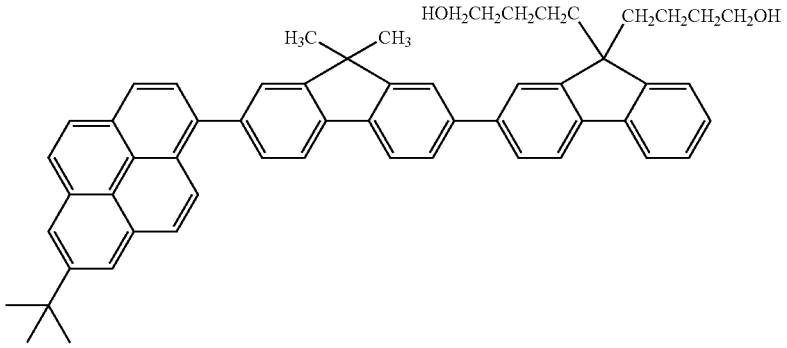
(I-25)
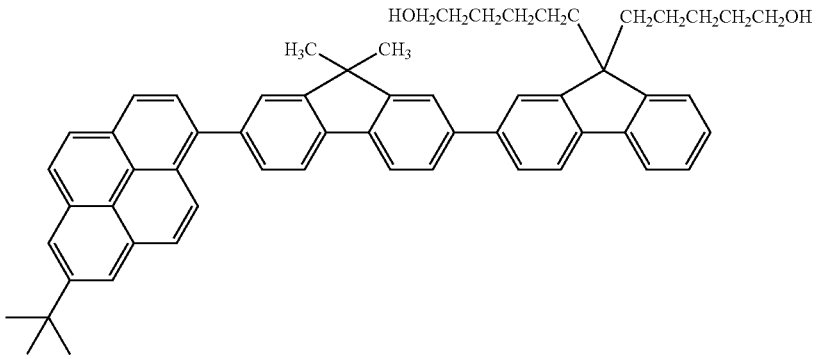
(I-26)
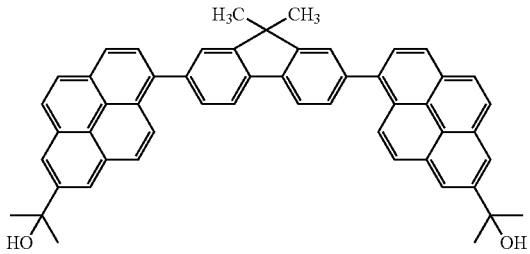
(I-27)
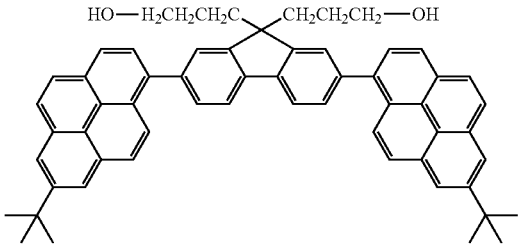

-continued
(I-28)
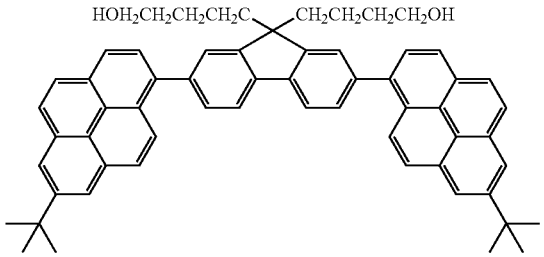
(I-29)
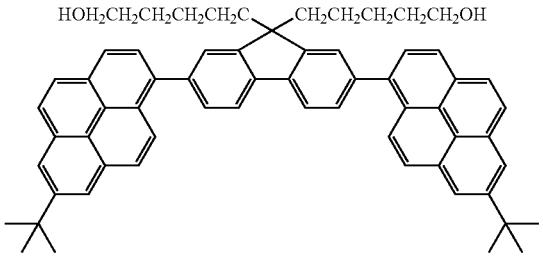
(I-30)
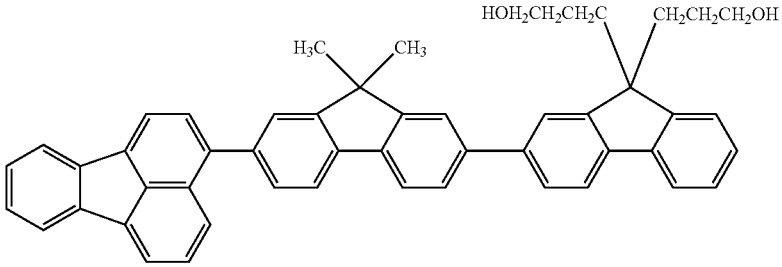
(I-31)
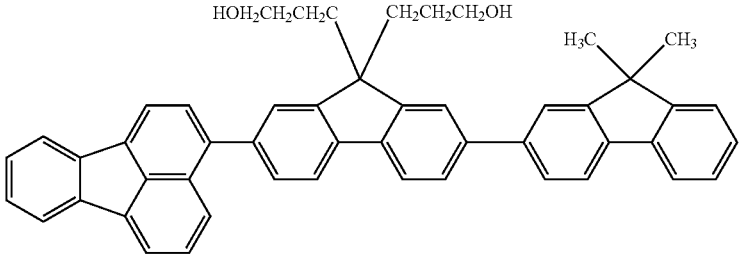
(I-32)
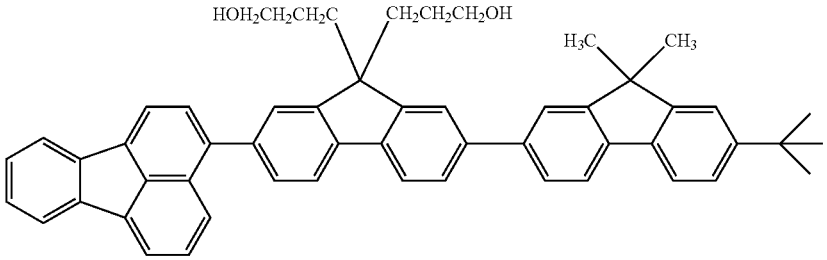
(I-33)
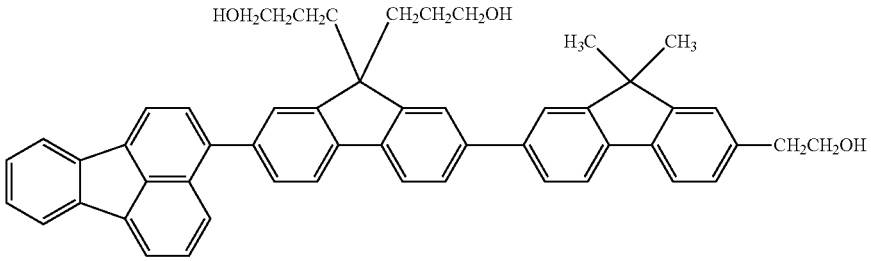

-continued
(I-34)
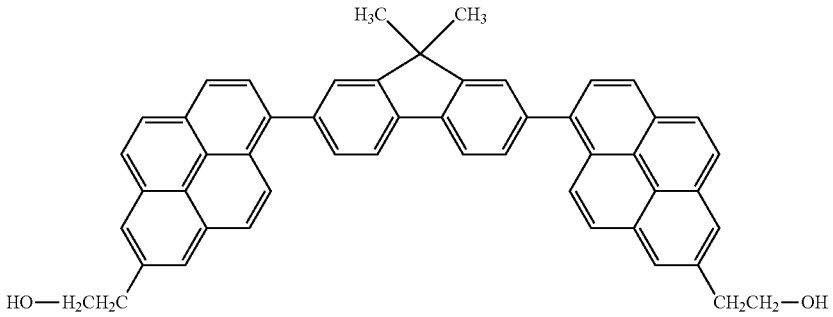
(I-35)
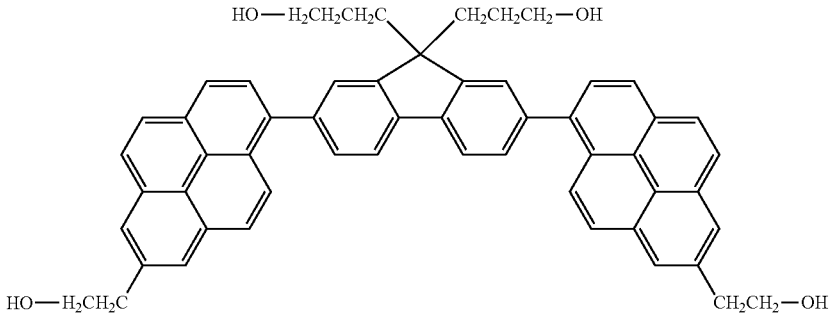
(I-36)
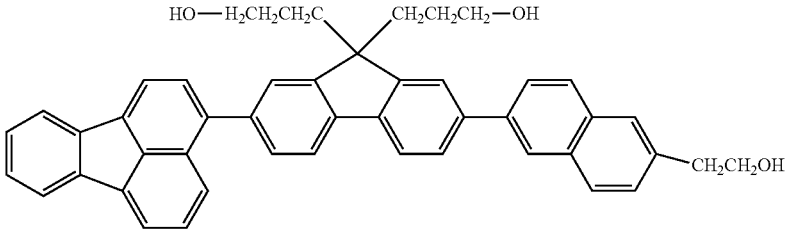
(I-37)
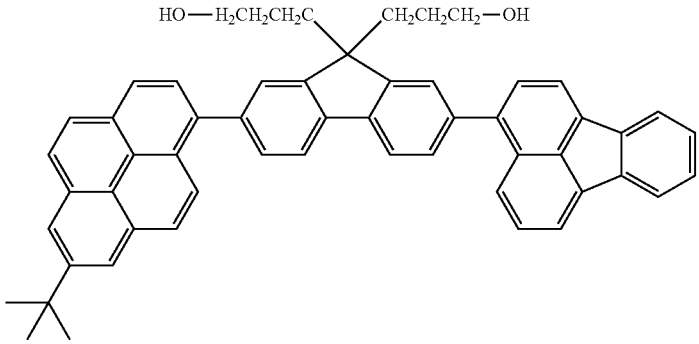
(I-38)
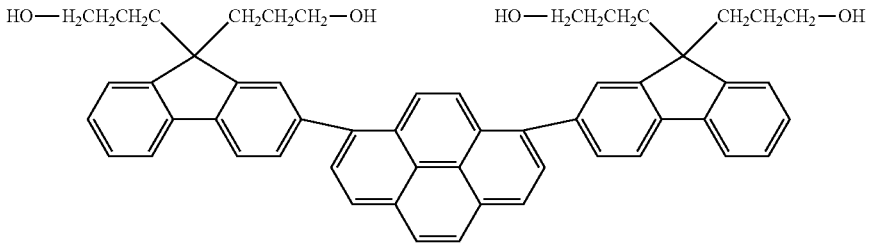

-continued
(I-39)
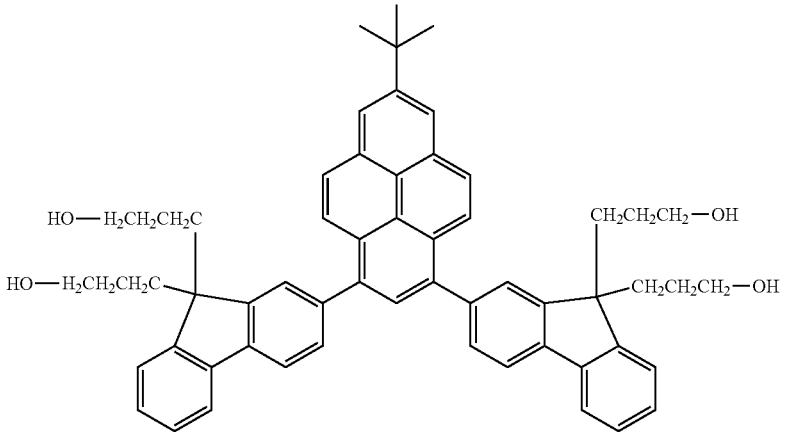
(I-40)
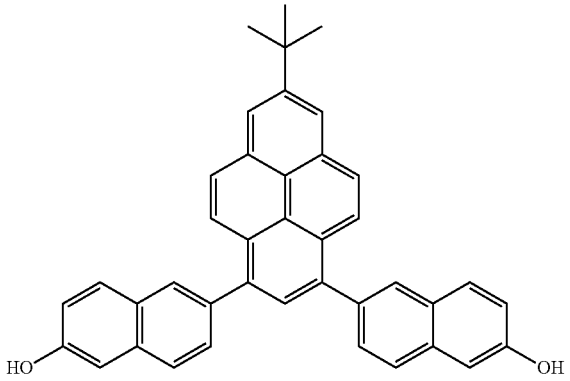
(I-41)
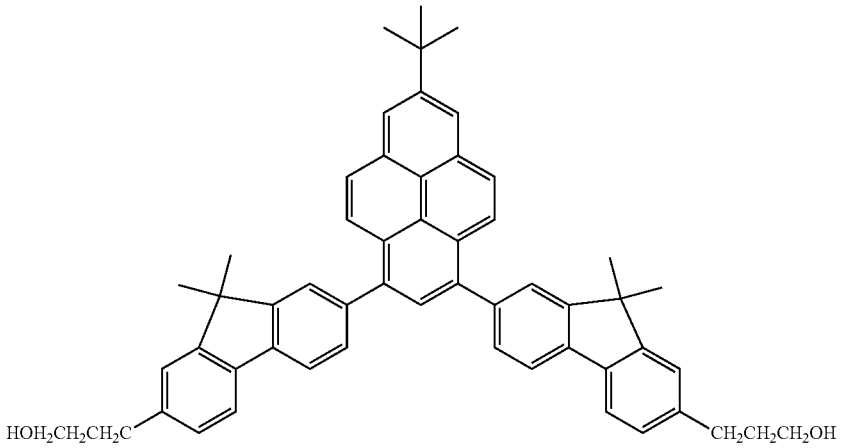
(I-42)
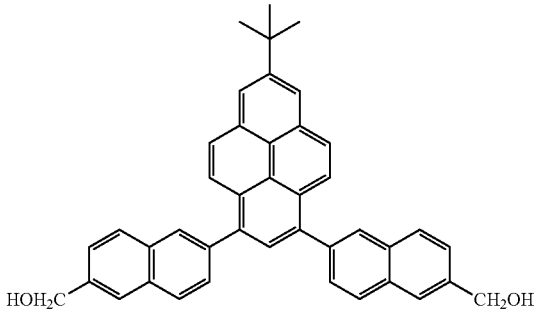
(I-43)
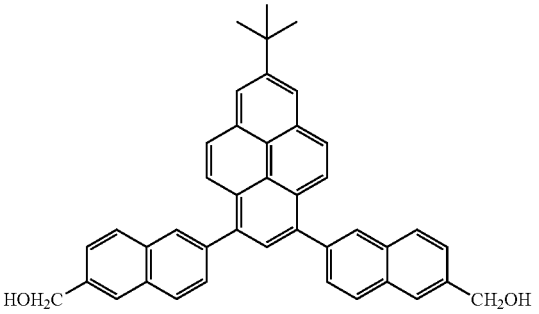

-continued
(I-44)
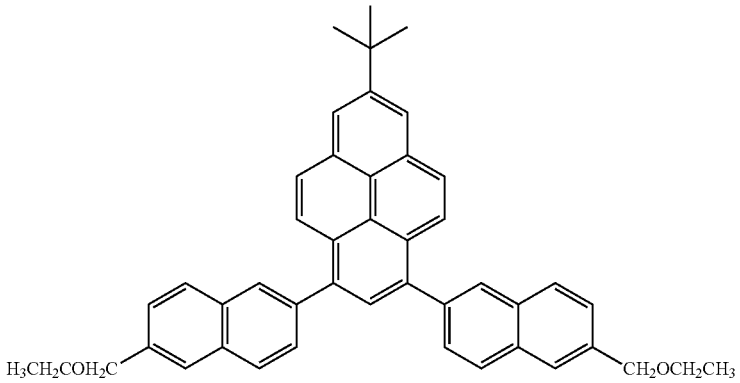
(I-45)
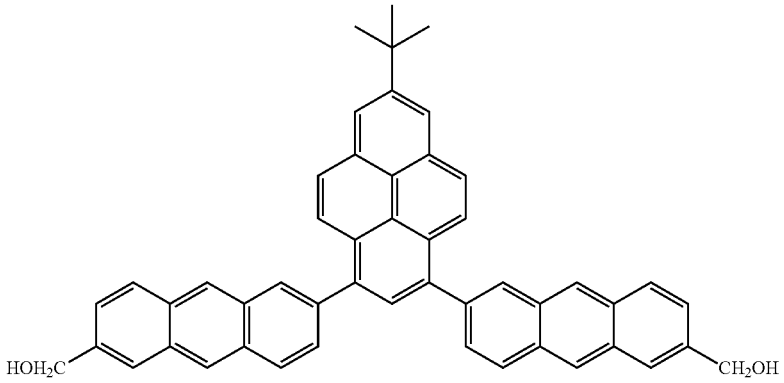
(I-46)
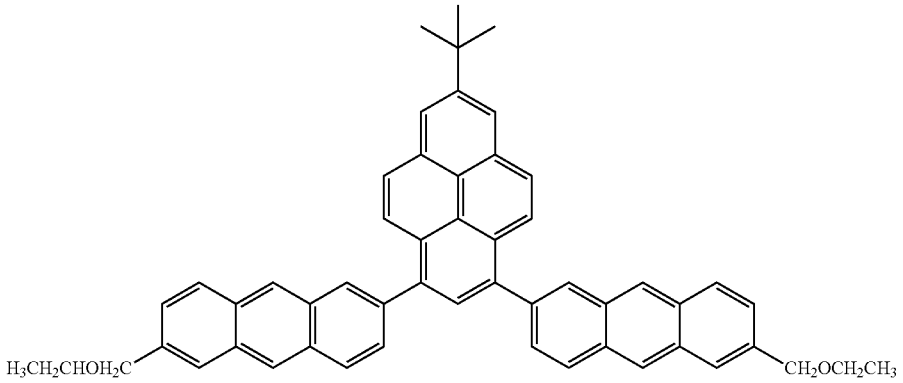
(I-47)
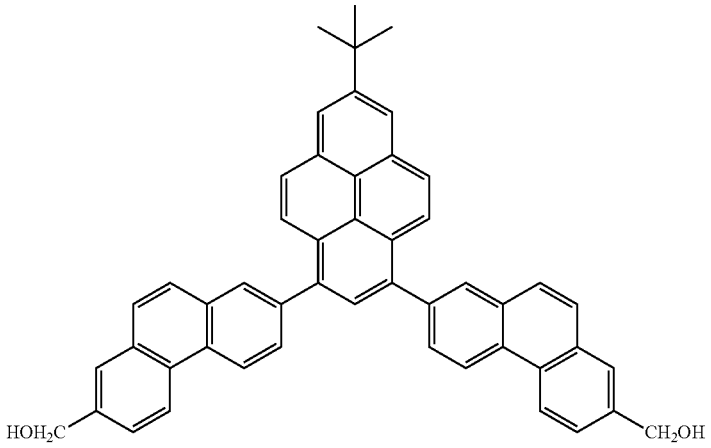

-continued
(I-48)
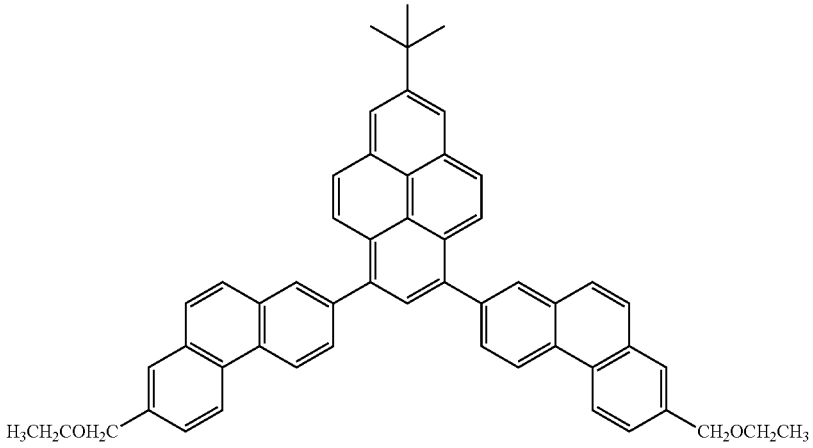
(I-49)
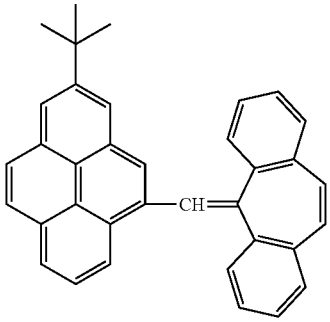
(I-50)
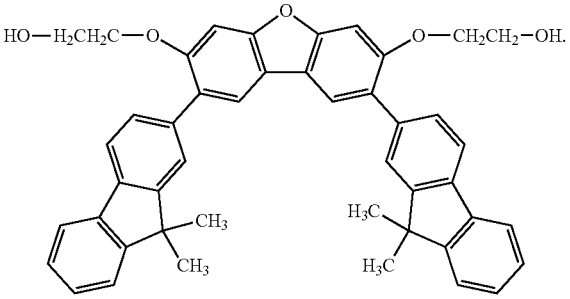
(I-51)
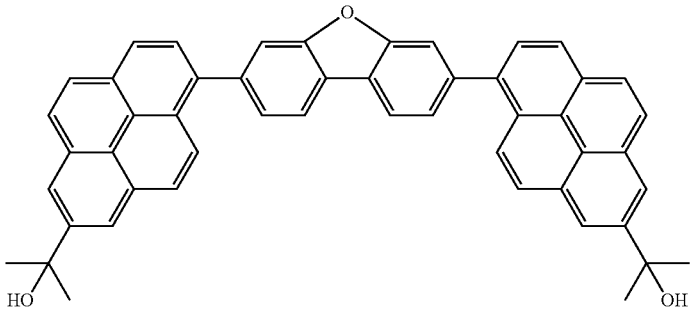
(I-52)
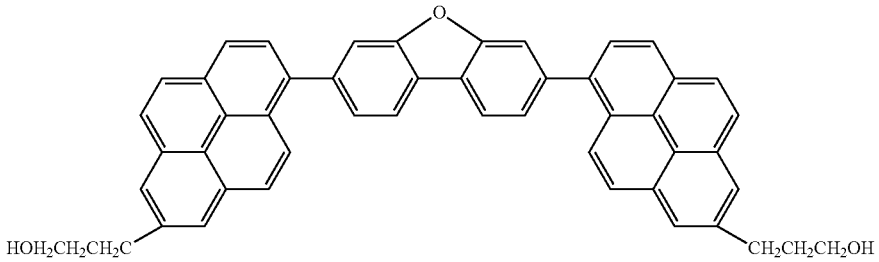

-continued
(I-53)
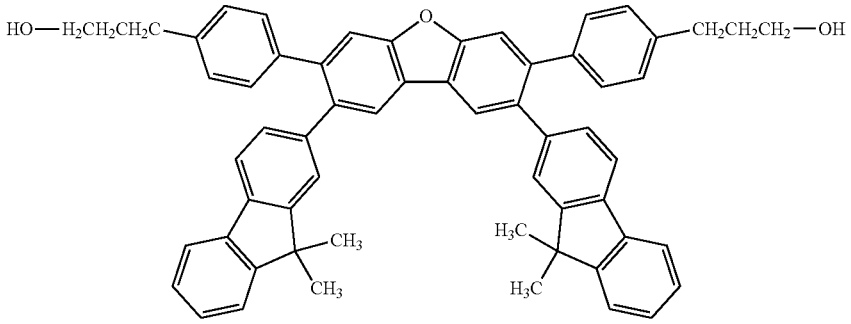
(I-54)
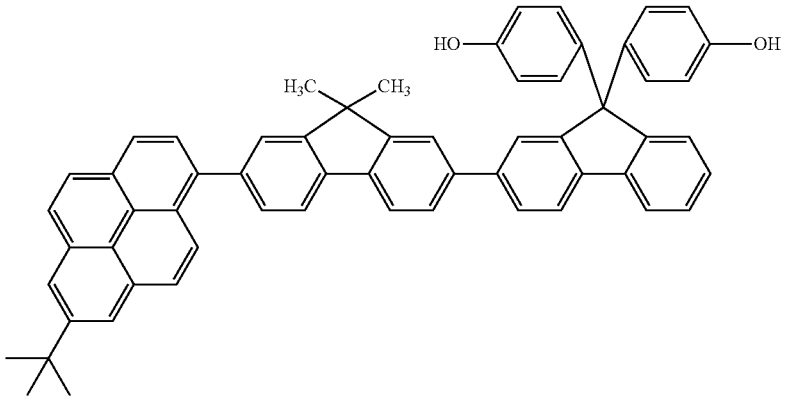
(I-55)
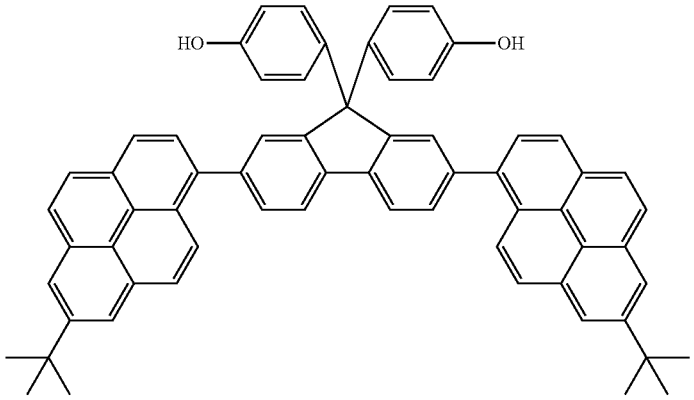
(I-56)
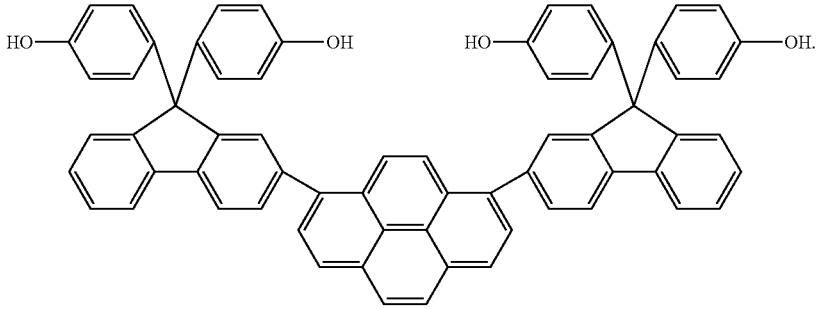

-continued
(I-57)
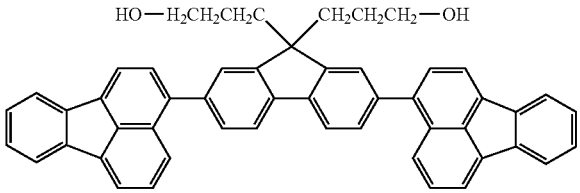
(I-58)
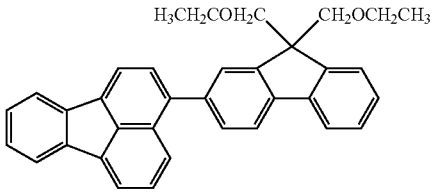
(I-59)
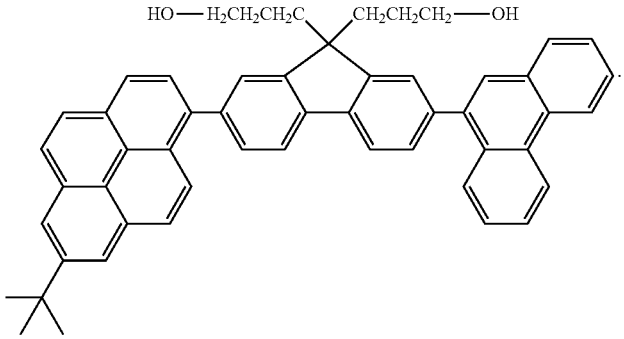
(I-60)
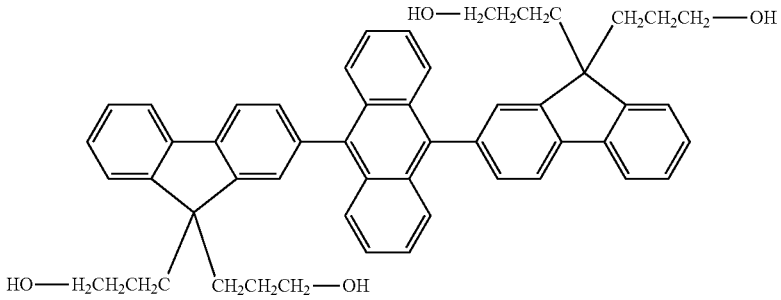
(I-61)
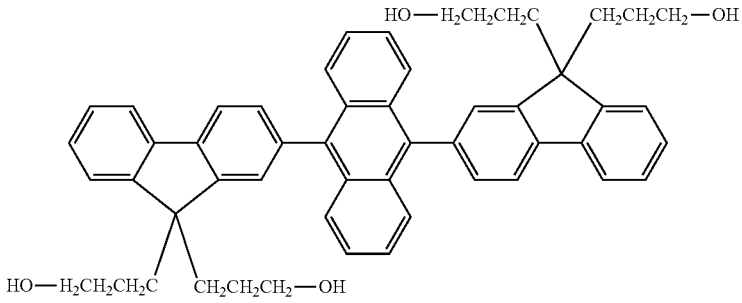
(I-62)
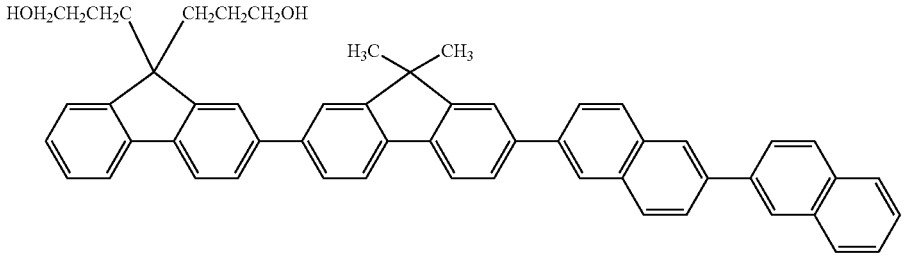

-continued
(I-63)
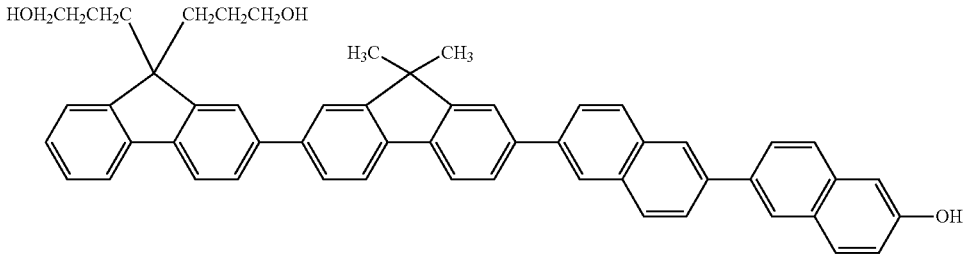
(I-64)
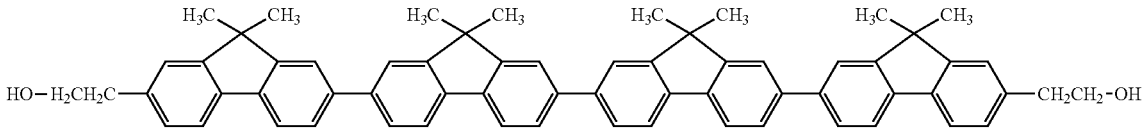
(I-65)
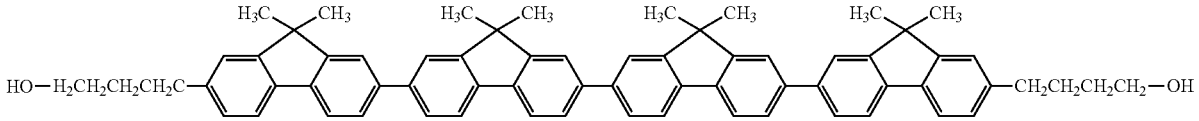
(I-66)
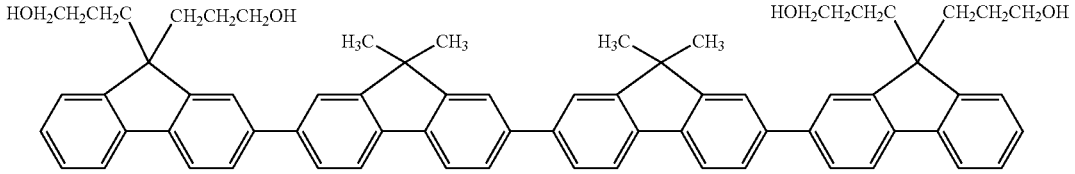
(I-67)
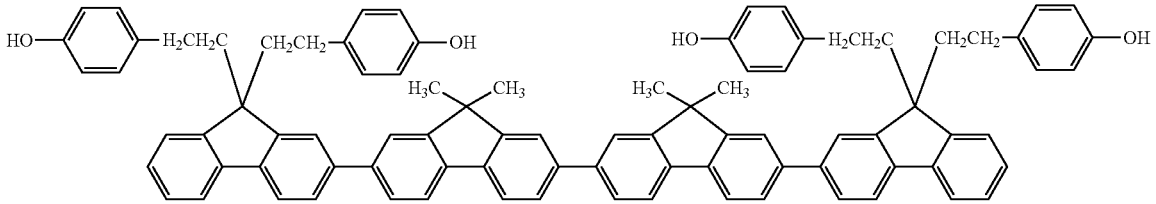
(I-68)
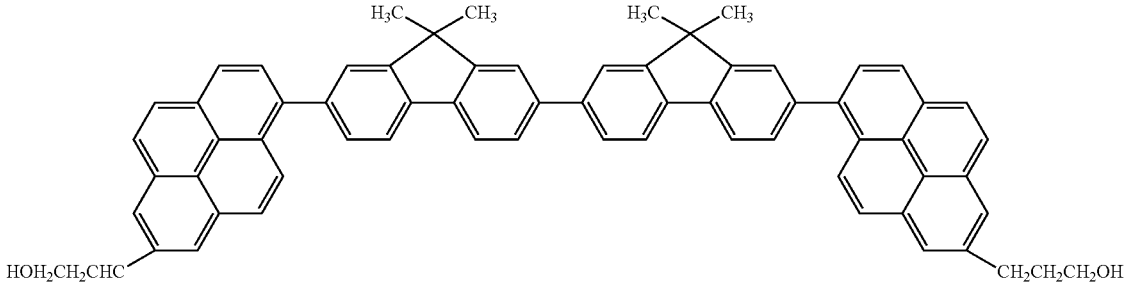
(I-69)
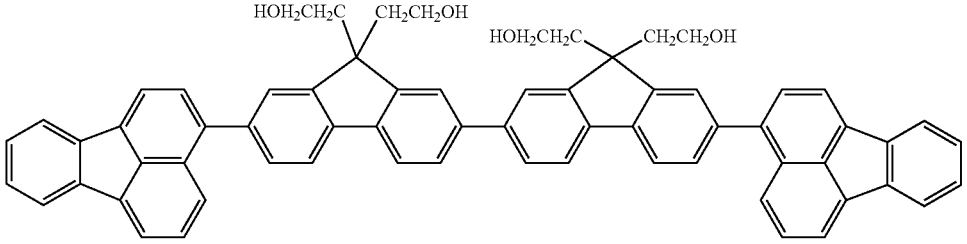

-continued
(I-70)
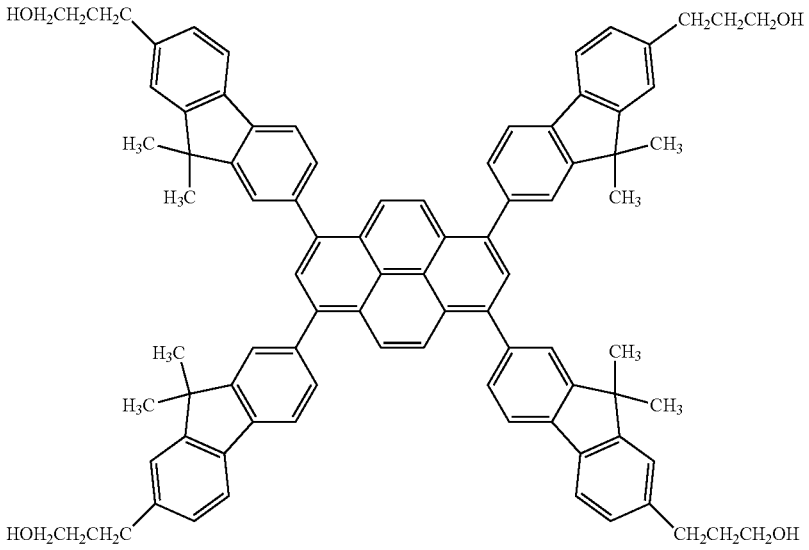
(I-71)
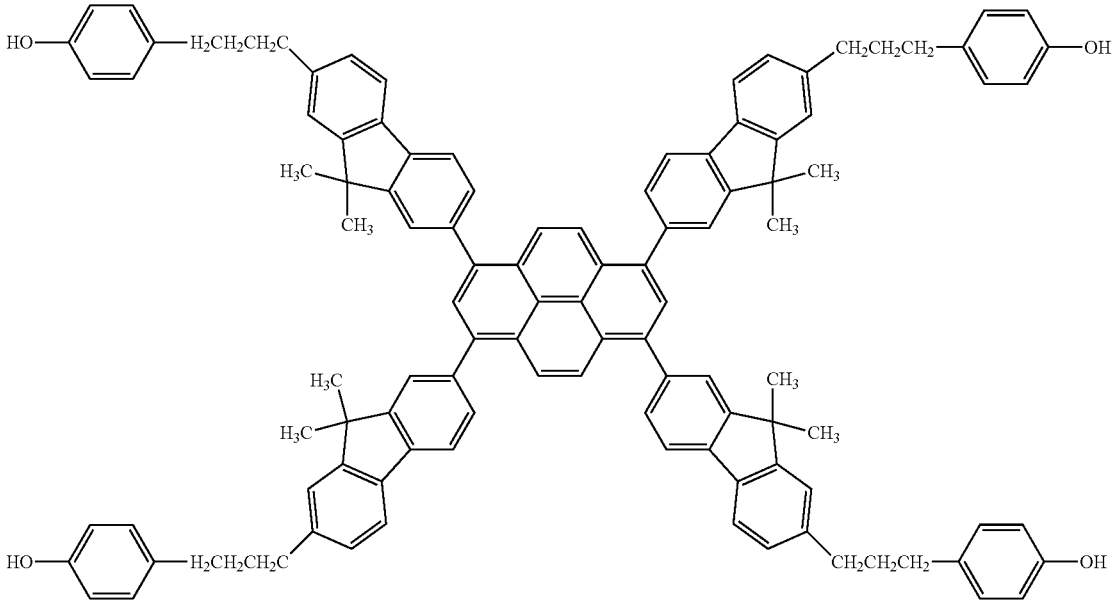
(I-72)
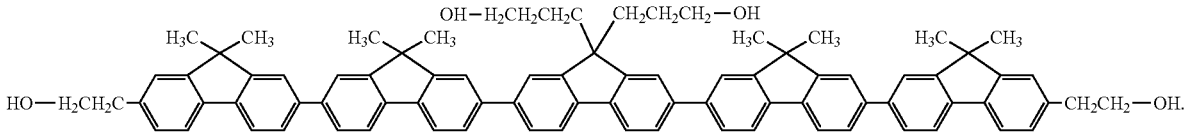
(I-73)
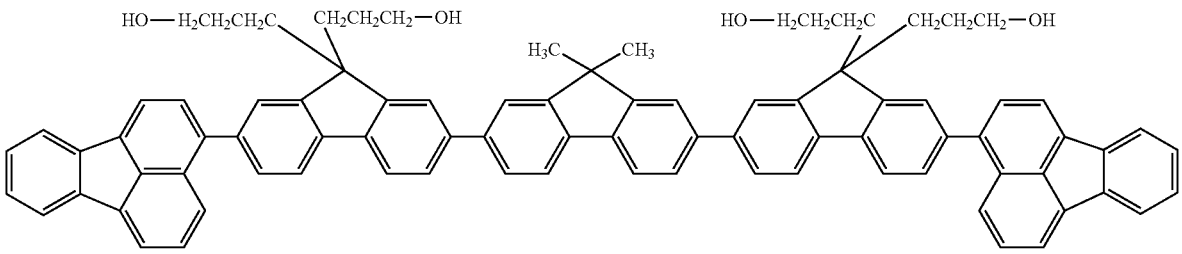

-continued
(I-74)
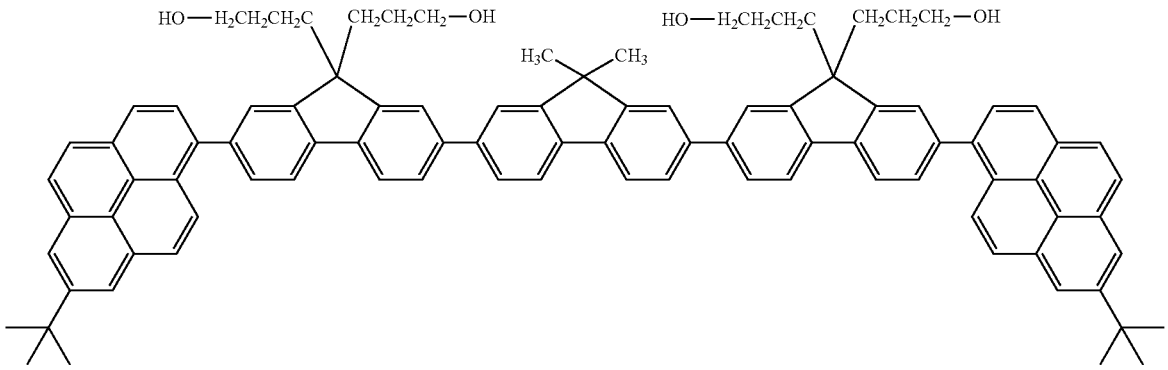
(I-75)
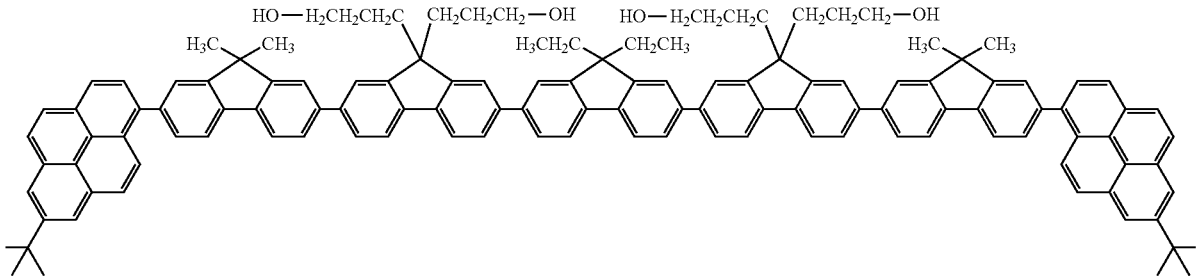
(I-76)
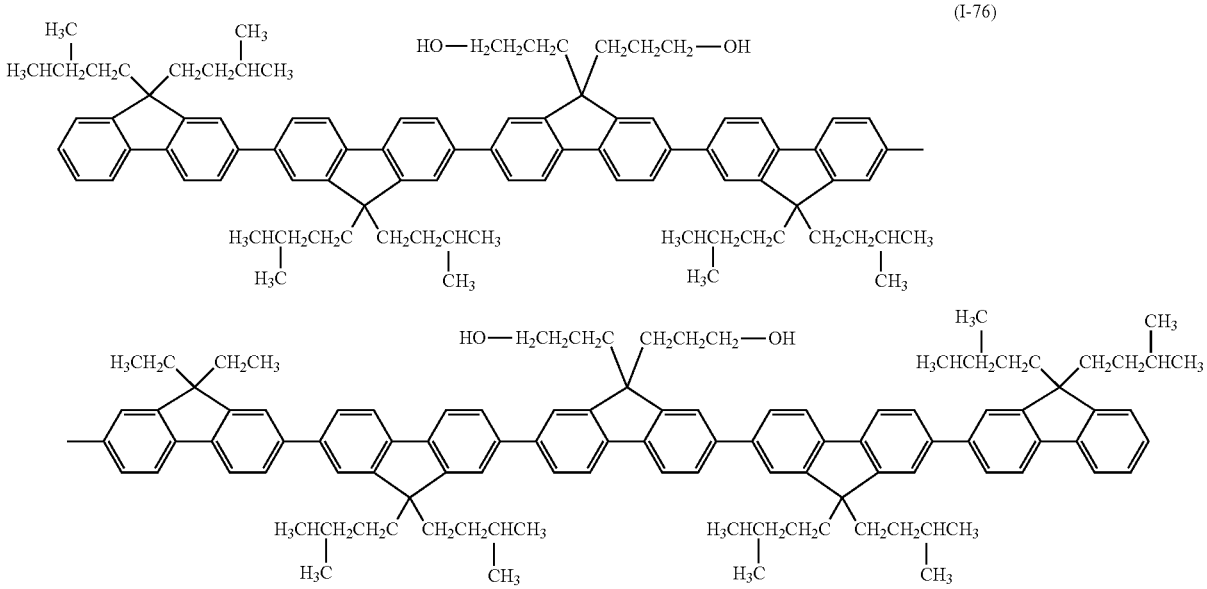
(I-77)
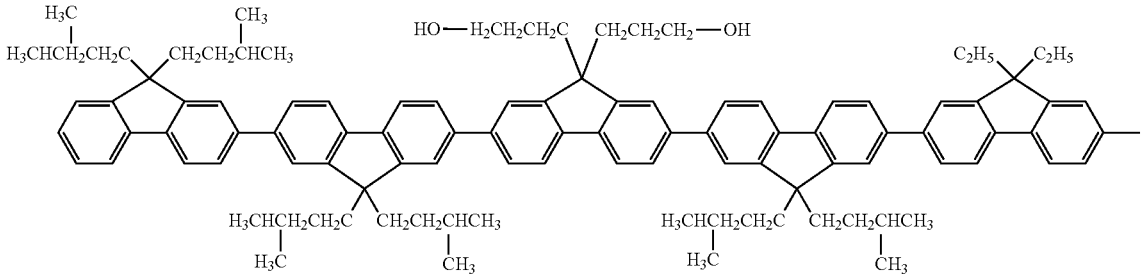

-continued
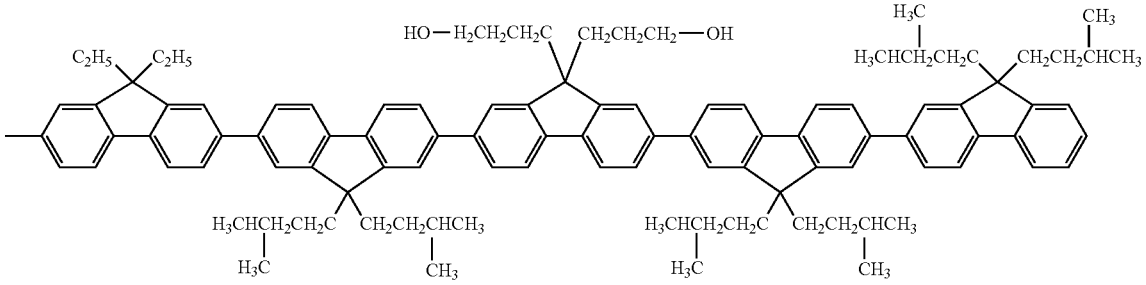
(I-78)
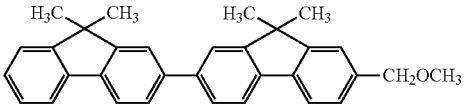
(I-79)
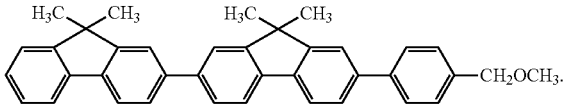
(I-80)
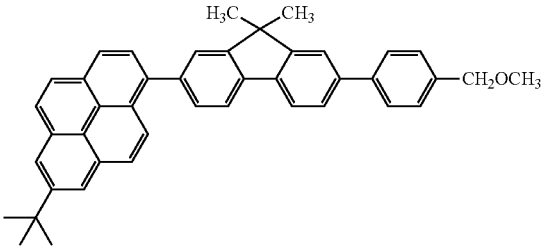
(I-81)
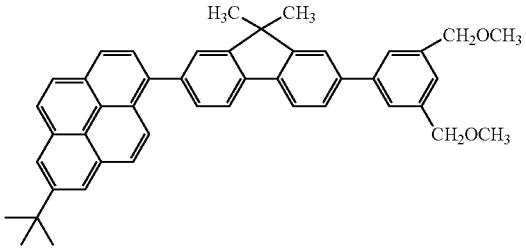
(I-82)
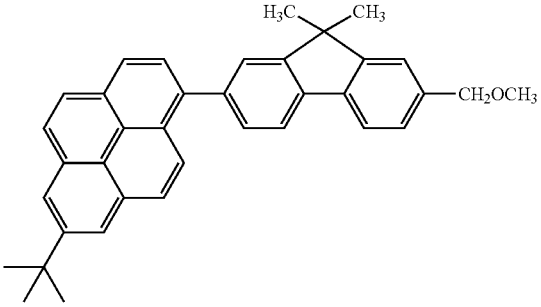
(I-83)
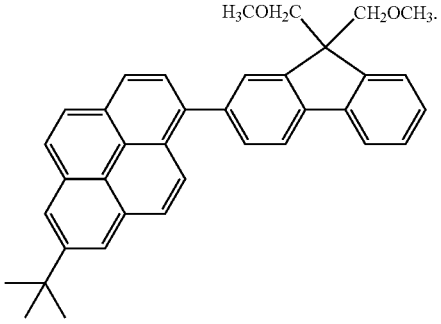
(I-84)
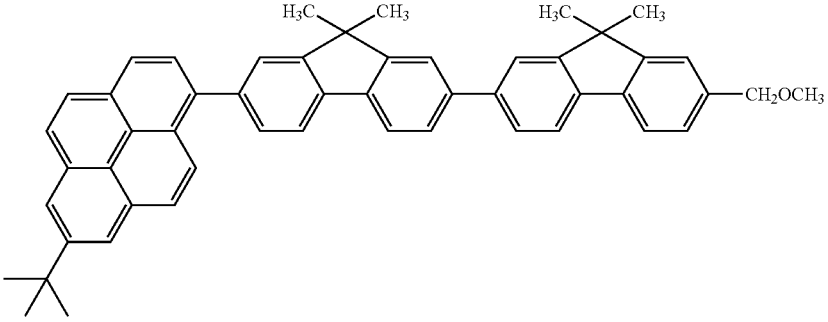

-continued
(I-85)
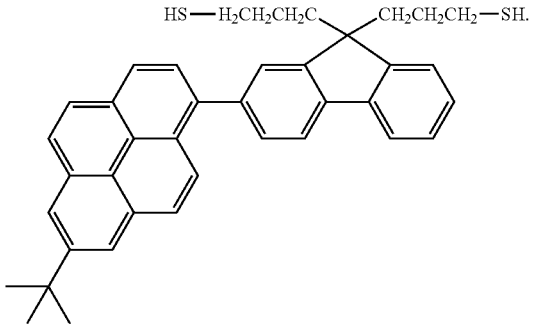
(I-86)
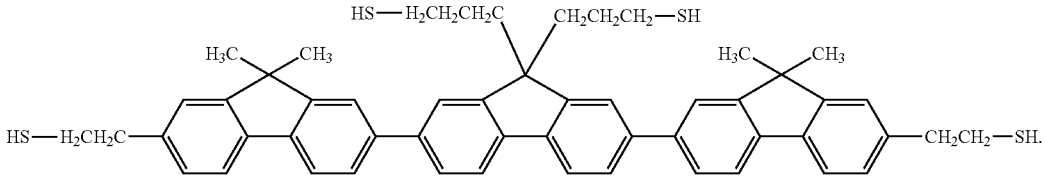
(I-87)
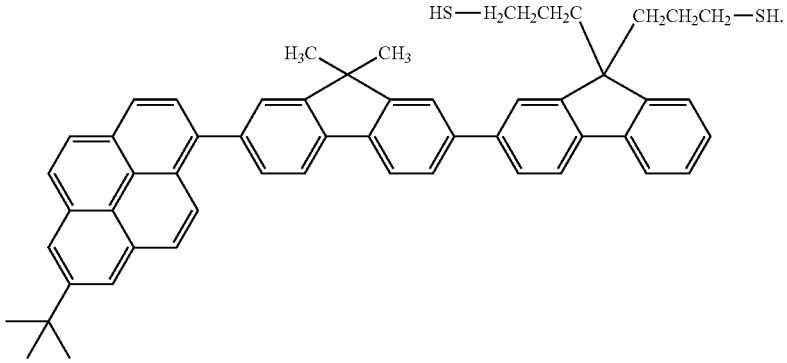
(I-88)
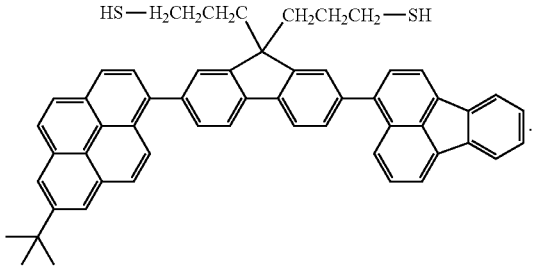
(I-89)
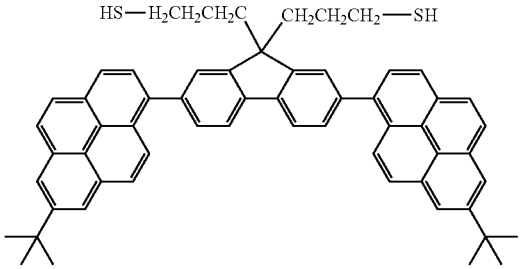
(I-90)
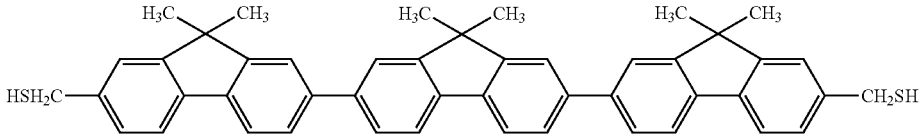

-continued
(I-91)
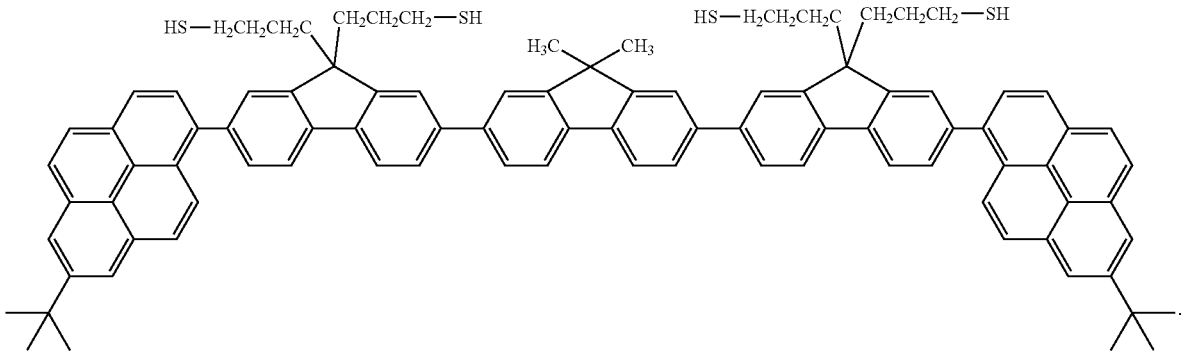
(I-92)
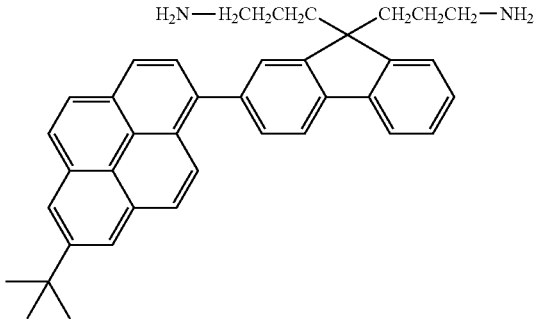
(I-93)
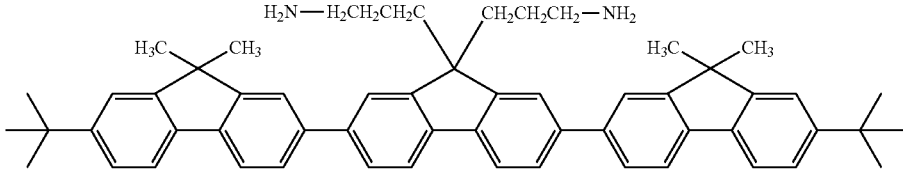
(I-94)
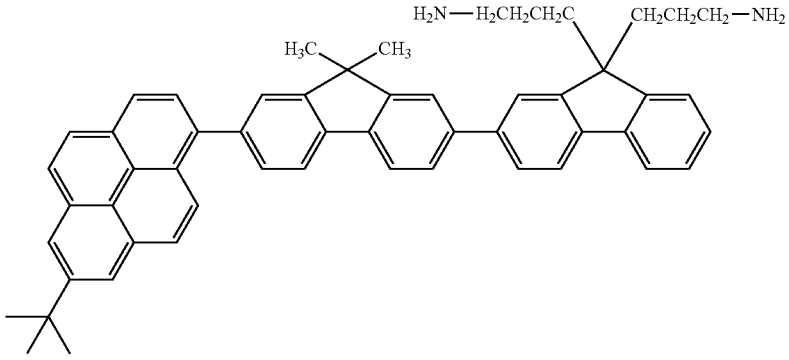
(I-95)
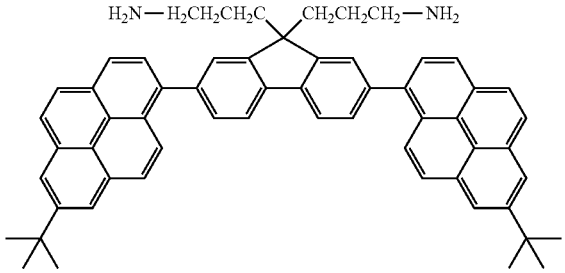
(I-96)
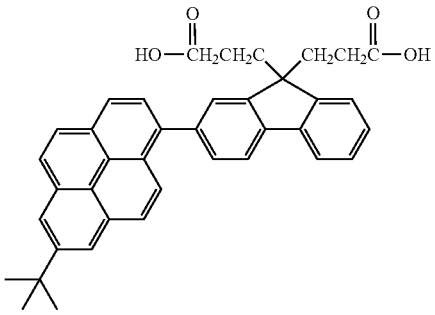

-continued
(I-97)
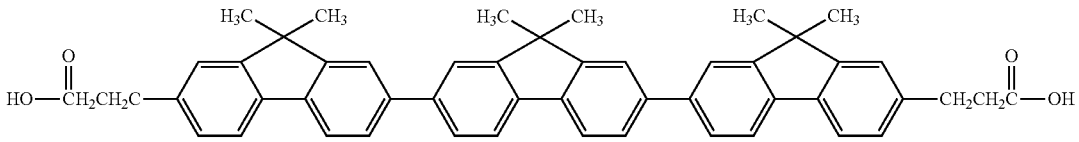
(I-98)
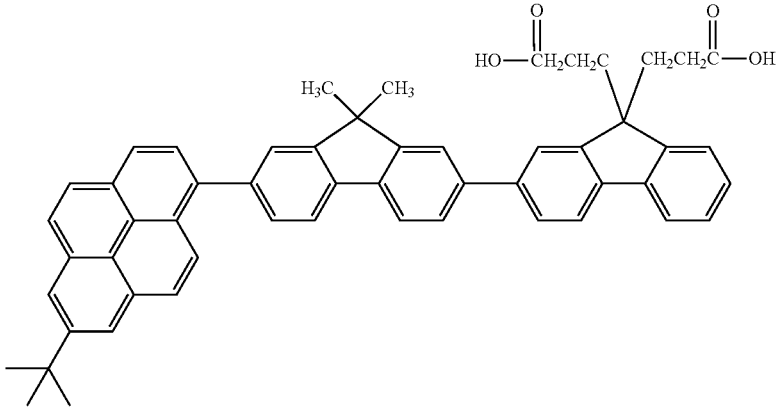
(I-99)
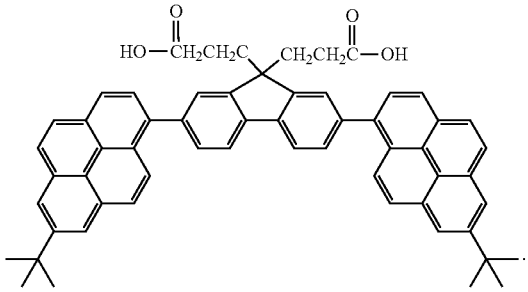
(I-100)
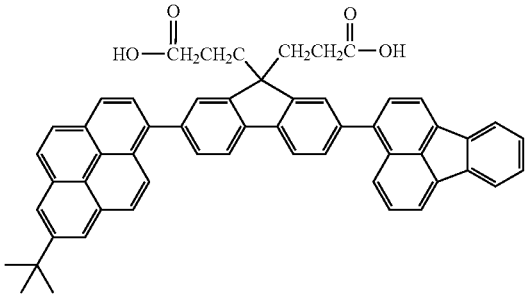
(I-101)
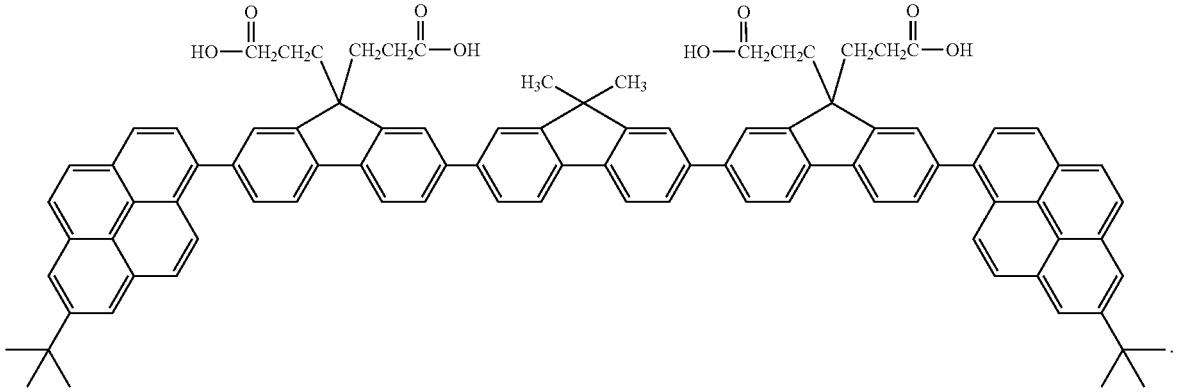
(I-102)
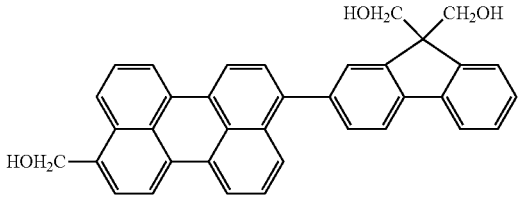
(I-103)
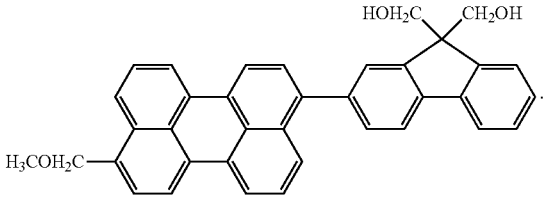

-continued (I-104)

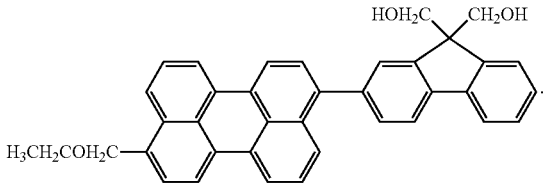

(I-105)

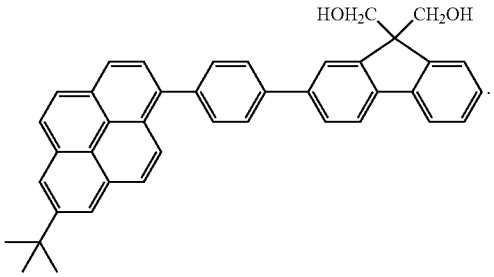

(I-106)

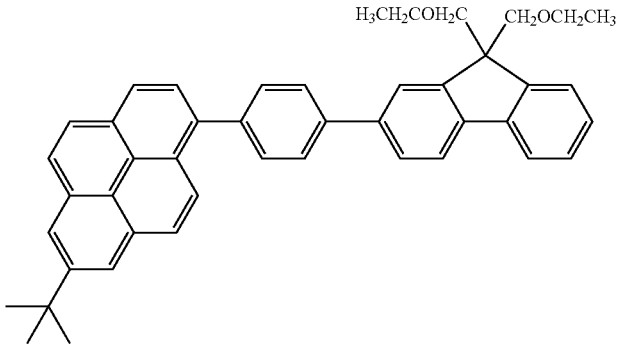

A representative synthesis example of the hole transport substance for use in the present invention is shown below.

A reaction represented by the following reaction formula was performed. A three-neck flask was equipped with a nitrogen introduction tube, a cooling tube, an inner thermometer and the like. Toluene (312 parts), 142 parts of ethanol and 180 parts of an aqueous 10% by mass sodium carbonate solution were mixed, and stirred well using a mechanical stirrer at room temperature for 30 minutes or more with nitrogen-gas bubbling, and nitrogen replacement was performed. Then, 12.2 parts of 7-tert-butylpyrene-1-boronic acid pinacol ester (MW=384.32), 7.0 parts of 9,9-di-1-propanol-2,7-dibromofluorene (MW=440.17) and 0.74 parts of tetrakis (triphenylphosphine) palladium were charged into the flask and further well stirred at room temperature, and dissolution and nitrogen replacement were performed.

Then, the flask was heated and a coupling reaction was performed at reflux temperature (about 74° C.) After the reaction was performed under reflux conditions for about 3 hours, the reaction mixture was cooled to room temperature. A separating funnel was used to separate an organic layer from an aqueous layer, and the resulting organic layer was further washed with water. The organic layer was taken out, and dehydrated using anhydrous magnesium sulfate. The magnesium sulfate was removed, and an organic solvent was removed from the organic layer to provide a crude product.

The crude product was purified by column chromatography using silica gel. A mixed solvent of toluene/ethyl acetate was used for developing to remove impurities, collecting an objective product (I-28, Mw=795.06). The yield was 11.2 parts, and the percent yield was 83%.

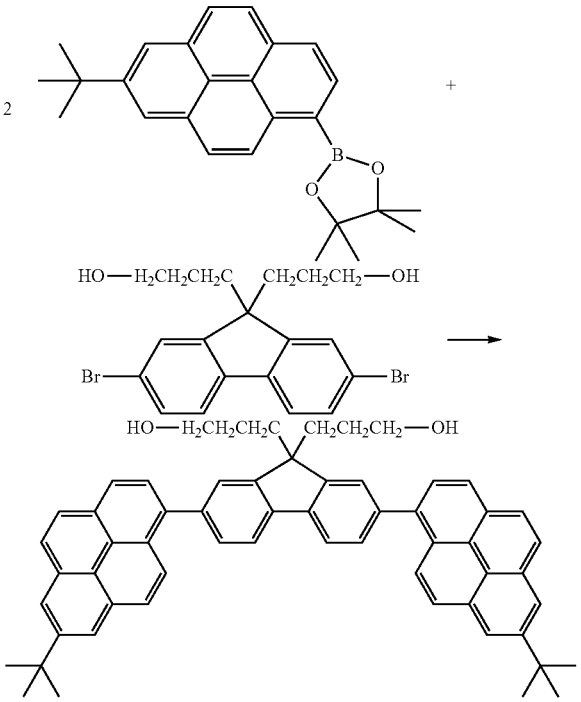

The content of the hole transporting compound having the first reactive functional group in the surface layer is preferably 95% by mass or more and 99% by mass or less based on the total mass of the composition. The content is further preferably 97% by mass or more and 99% by mass or less. When the content is in the above range, electric characteristics are further enhanced. Herein, while the solid content concentration can be higher, the solid content concentration is 99% by mass or less for allowing the compound having a second reactive functional group and other additives to effectively function.

The compound having a second reactive functional group of the present invention is a compound having a reactive functional group reactable with the first reactive functional group. The compound having a second reactive functional group is preferably a melamine compound, a guanamine compound, a urea compound, an isocyanate compound or an aniline compound. Among these, a melamine compound, a guanamine compound, a urea compound or an isocyanate compound is preferable. A melamine compound, a guanamine compound or an isocyanate compound is more preferable.

The melamine compound, the guanamine compound, the urea compound and the aniline compound have a group represented by —$CH_2$—OH or a group represented by —$CH_2$—O—R as the reactive functional group. The compounds may be the same as or different from the first reactive functional group. R represents a hydrogen atom, or a linear or branched alkyl group having 1 or more and 10 or less carbon atoms.

The content of the compound having a second reactive functional group in the composition is preferably 0.1% by mass or more and 5% by mass or less, and further preferably 1% by mass or more and 3% by mass or less. When the content is in the above range, the effects of wear resistance and suppression of image deletion are further exerted.

The unit for subjecting the hole transporting compound of the present invention and the compound having a second reactive functional group to a polymerization reaction includes the following. That is, a unit for applying energy such as ultraviolet lay, electron beam and heat, or a unit in which an aid such as a polymerization initiator, and a compound such as an acid, an alkali, and a complex are allowed to co-exist can be used.

The surface layer can be formed by applying a surface layer-coating liquid, obtained by dissolving the hole transporting compound of the present invention and the compound having a second reactive functional group in an organic solvent, to form a coat, and drying and curing the resulting coat.

The method for curing the coat of the surface layer-coating liquid (method for polymerizing the hole transporting compound of the present invention) includes a method for polymerizing the hole transporting compound using heat, light (ultraviolet ray or the like) or radiation (electron beam or the like).

Electrophotographic Photosensitive Member

The electrophotographic photosensitive member of the present invention is an electrophotographic photosensitive member including a support and a photosensitive layer formed on the support, as described above.

The photosensitive layer includes a single layer type photosensitive layer in which a charge generation substance and a charge transport substance are contained in the same layer, and a laminated type (functional separation type) photosensitive layer in which a charge generation layer containing a charge generation substance and a charge transport layer containing a charge transport substance are separated. In the present invention, a laminated type photosensitive layer can be adopted. In addition, a laminate configuration of a charge generation layer and a charge transport layer can also be adopted.

Figure 2:
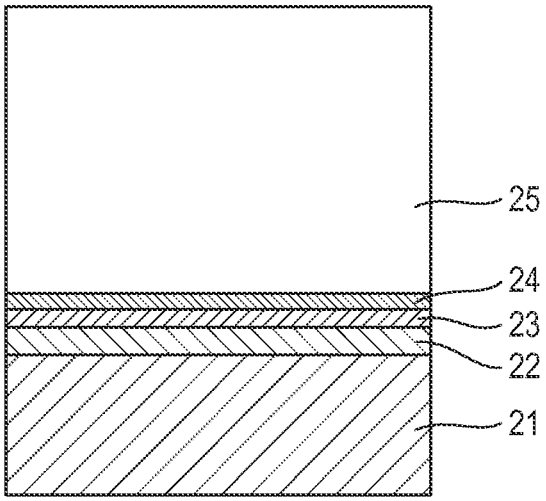
FIG. 2 is a view for illustrating a layer configuration of an electrophotographic photosensitive member.

A schematic configuration that can be used for the electrophotographic photosensitive member of the present invention is illustrated in FIG. 2. In an electrophotographic photosensitive member illustrated in FIG. 2, a support 21, an undercoat layer 22 formed on the support, a charge generation layer 23 formed on the undercoat layer, a charge transport layer 24 formed on the charge generation layer and a surface layer 25 formed on the charge transport layer are laminated.

The support for use in the present invention can be a conductive support made of a material having conductivity. Examples of the material of the support include metals and alloys, such as iron, copper, gold, silver, aluminum, zinc, titanium, lead, nickel, tin, antimony, indium, chromium, an aluminum alloy and stainless. In addition, a metallic support having a covering film formed by vacuum vapor deposition of aluminum, an aluminum alloy, an indium oxide-tin oxide alloy or the like, or a resin support can also be used. In addition, a support obtained by impregnating plastic or paper with conductive particles such as carbon black, tin oxide particles, titanium oxide particles and silver particles, or a support containing a conductive resin can also be used. The shape of the support includes a cylinder shape, a belt shape, a sheet shape or a plate shape, and a cylinder shape is most commonly used.

The surface of the support may be subjected to a cutting treatment, a roughening treatment, an alumite treatment or the like for the purpose of suppressing an interference fringe by scattering of laser light.

A conductive layer may also be provided between the support and the undercoat layer or the charge generation layer described later, for the purpose of suppressing an interference fringe by scattering of laser or the like or covering scratch on the support.

The conductive layer can be formed by forming a coat of a conductive layer-coating liquid obtained by subjecting carbon black, a conductive pigment, a resistance-regulating pigment, or the like together with a binder resin to a dispersing treatment, and drying the resulting coat. A compound that is to be cured and polymerized by heating, ultraviolet irradiation, radiation irradiation or the like may also be added to the conductive layer-coating liquid. A conductive layer in which a conductive pigment or a resistance-regulating pigment is dispersed tends to have a roughened surface.

The solvent of the conductive layer-coating liquid includes an ether-based solvent, an alcohol-based solvent, a ketone-based solvent and an aromatic hydrocarbon solvent. The thickness of the conductive layer is preferably 0.1 μm or more and 50 μm or less, further preferably 0.5 μm or more and 40 μm or less, and further more preferably 1 μm or more and 30 μm or less.

The binder resin for use in the conductive layer includes polymers and copolymers of vinyl compounds such as styrene, vinyl acetate, vinyl chloride, acrylate, methacrylate, vinylidene fluoride and trifluoroethylene, a polyvinyl alcohol resin, a polyvinyl acetal resin, a polycarbonate resin, a polyester resin, a polysulfone resin, a polyphenylene oxide resin, a polyurethane resin, a cellulose resin, a phenol resin, a melamine resin, a silicon resin, an epoxy resin and an isocyanate resin.

The conductive pigment and the resistance-regulating pigment include particles of metals (alloys) such as aluminum, zinc, copper, chromium, nickel, silver and stainless, and a pigment obtained by vapor-depositing such a metal (alloy) on the surface of plastic particles. In addition, the pigments may be made of particles of metal oxides such as zinc oxide, titanium oxide, tin oxide, antimony oxide, indium oxide, bismuth oxide, tin-doped indium oxide and antimony or tantalum-doped tin oxide. Such pigments may be used singly or in combination of two or more.

An undercoat layer (intermediate layer) having a barrier function or an adhesion function may also be provided between the support or the conductive layer and the charge generation layer for the purpose of the improvements in adhesiveness of the charge generation layer, in coatability and in hole-injecting properties from the support, and the protection of the charge generation layer from electrical breakdown or the like.

The undercoat layer can be formed by forming a coat of an undercoat layer-coating liquid obtained by dissolving a binder resin in a solvent, and drying the resulting coat.

The binder resin for use in the undercoat layer includes a polyvinyl alcohol resin, poly-N-vinylimidazole, a polyethylene oxide resin, ethylcellulose, an ethylene-acrylic acid copolymer, casein, a polyamide resin, an N-methoxymethylated 6-nylon resin, a copolymerized nylon resin, a phenol resin, a polyurethane resin, an epoxy resin, an acrylic resin, a melamine resin or a polyester resin.

The undercoat layer may further contain metal oxide particles. The metal oxide particles include particles containing titanium oxide, zinc oxide, tin oxide, zirconium oxide or aluminum oxide. In addition, the metal oxide particles may be metal oxide particles whose surface is treated with a surface treatment agent such as a silane coupling agent.

The solvent for use in the undercoat layer-coating liquid includes organic solvents such as an alcohol-based solvent, a sulfoxide-based solvent, a ketone-based solvent, an ether-based solvent, an ester-based solvent, an aliphatic halogenated hydrocarbon-based solvent and an aromatic compound. The thickness of the undercoat layer is preferably 0.05 μm or more and 30 μm or less, and more preferably 1 μm or more and 25 μm or less. The undercoat layer may further contain organic resin fine particles and a leveling agent.

Then, the charge generation layer is described. The charge generation layer can be formed by applying a charge generation layer-coating liquid obtained by subjecting a charge generation substance together with a binder resin and a solvent to a dispersing treatment, and drying the resulting coat. In addition, the charge generation layer may be a film by vapor deposition of the charge generation substance.

The charge generation substance for use in the charge generation layer includes an azo pigment, a phthalocyanine pigment, an indigo pigment, a perylene pigment, a polycyclic quinone pigment, a squarylium dye, a pyrylium salt, a thiapyrylium salt, a triphenylmethane dye, a quinacridone pigment, an azulenium salt pigment, a cyanine dye, an anthanthrone pigment, a pyranthrone pigment, a xanthene dye, a quinonimine dye and a styryl dye. Such charge generation substances may be used singly or in combination of two or more. Among such charge generation substances, a phthalocyanine pigment and an azo pigment are preferable, and in particular a phthalocyanine pigment is more preferable from the viewpoint of sensitivity.

As the phthalocyanine pigment, in particular, oxytitanium phthalocyanine, chlorogallium phthalocyanine and hydroxygallium phthalocyanine exhibit an excellent charge generation efficiency. Furthermore, as the hydroxygallium phthalocyanine, hydroxygallium phthalocyanine crystal of a crystal form having strong peaks at Bragg angles 2θ, 7.4°±0.3° and 28.2°±0.3°, in CuKα characteristic X-ray diffraction can be adopted from the viewpoint of sensitivity.

Examples of the binder resin for use in the charge generation layer include polymers of vinyl compounds such as styrene, vinyl acetate, vinyl chloride, acrylate, methacrylate, vinylidene fluoride and trifluoroethylene, a polyvinyl alcohol resin, a polyvinyl acetal resin, a polycarbonate resin, a polyester resin, a polysulfone resin, a polyphenylene oxide resin, a polyurethane resin, a cellulose resin, a phenol resin, a melamine resin, a silicon resin and an epoxy resin.

The mass ratio of the charge generation substance to the binder resin can be in a range from 1:0.3 to 1:4.

Examples of the dispersing treatment method include a method using a homogenizer, ultrasonic dispersing, a ball mill, a vibration ball mill, a sand mill, Attritor, a roll mill or the like.

The solvent for use in the charge generation layer-coating liquid includes an alcohol-based solvent, a sulfoxide-based solvent, a ketone-based solvent, an ether-based solvent, an ester-based solvent, an aliphatic halogenated hydrocarbon-based solvent and an aromatic compound.

Then, the charge transport layer is described. The charge transport layer is formed on the charge generation layer. The charge transport layer contains a charge transport substance and a thermoplastic resin. The thermoplastic resin includes a polycarbonate resin and a polyester resin. The thermoplastic resin can be a polycarbonate resin.

The charge transport substance for use in the charge transport layer includes a triarylamine-based compound, a hydrazone compound, a stilbene compound, a pyrazoline-based compound, an oxazole-based compound, a triallylmethane-based compound and a thiazole-based compound. Such charge transport substances may be used singly or in combination of two or more.

The charge transport layer can be formed by forming a coat of a charge transport layer-coating liquid obtained by dissolving a charge transport substance and a thermoplastic resin in a solvent, and drying the resulting coat. With respect to the ratio of the charge transport substance to the thermoplastic resin in the charge transport layer, the ratio of the charge transport substance can be 0.3 parts by mass or more and 10 parts by mass or less based on 1 part by mass of the thermoplastic resin.

The drying temperature is preferably 60° C. or higher and 150° C. or lower, and more preferably 80° C. or higher and 120° C. or lower, from the viewpoint of suppressing cracking of the charge transport layer. In addition, the drying time can be 10 minutes or more and 60 minutes or less.

The solvent for use in the charge transport layer-coating liquid includes an alcohol-based solvent, a sulfoxide-based solvent, a ketone-based solvent, an ether-based solvent, an ester-based solvent, an aliphatic halogenated hydrocarbon-based solvent and an aromatic hydrocarbon-based solvent. The thickness of the charge transport layer is preferably 5 μm to 40 μm, and in particular, more preferably 10 μm to 35 μm.

In addition, an antioxidant, an ultraviolet ray absorber and a plasticizer can also be added to the charge transport layer, if necessary. In addition, the charge transport layer may contain fluorine atom-containing resin particles, silicone-containing resin particles and the like. In addition, the charge transport layer may contain metal oxide particles and inorganic particles.

Then, the protective layer is described. The protective layer is formed on the charge transport layer, and in such a case, the protective layer is the surface layer.

The protective layer contains a polymerized product of a composition including the hole transporting compound having the first reactive functional group, and the compound having a second reactive functional group reactable with the first reactive functional group. The respective compounds are as described above.

When the surface layer is the protective layer, the thickness thereof is preferably 0.1 μm or more and 15 μm or less, and further more preferably 0.5 μm or more and 10 μm or less. The solvent for use in the surface layer-coating liquid includes an alcohol-based solvent, a sulfoxide-based solvent, a ketone-based solvent, an ether-based solvent, an ester-based solvent, an aliphatic halogenated hydrocarbon-based solvent and an aromatic hydrocarbon-based solvent. The solvent can be an alcohol-based solvent from the viewpoint of not dissolving the charge transport layer as a lower layer.

In addition, the surface layer of the electrophotographic photosensitive member may contain a lubricant such as conductive particles, a silicone oil, wax, fluorine atom-containing resin particles including polytetrafluoroethylene particles, silica particles, alumina particles and boron nitride.

Various additives may be added to the surface layer. The additives include a coatability improver such as a leveling agent, organic resin particles such as fluorine atom-containing resin particles and acrylic resin particles, and inorganic particles such as silica, titanium oxide and alumina particles.

When the coating liquid for each of the layers is applied, any known coating method such as a dip coating method, a spray coating method, a ring coating method, a spin coating method, a roller coating method, a Meyer bar coating method or a blade coating method can also be used.

Then, FIG. 1 illustrates one example of a schematic configuration of an electrophotographic apparatus provided with the electrophotographic photosensitive member and the process cartridge of the present invention.

In FIG. 1, reference number 1 represents a cylindrical electrophotographic photosensitive member, which is rotatably driven at a predetermined circumferential speed around an axis 2 in the direction shown by an arrow. The peripheral surface of the electrophotographic photosensitive member 1 to be rotatably driven is uniformly charged to a predetermined positive or negative potential by a charging unit (primary charging unit: charging roller or the like) 3. Then, the charged peripheral surface is subjected to exposure light (image exposure light) 4 that is emitted from an exposing unit (not illustrated) such as slit exposure or laser beam scanning exposure. In this way, an electrostatic latent image according to the intended image is sequentially formed on the peripheral surface of the electrophotographic photosensitive member 1. The voltage to be applied to the charging unit 3 may be a voltage in which an AC component is superimposed to a DC component, or a voltage of only a DC component.

The electrostatic latent image formed on the peripheral surface of the electrophotographic photosensitive member 1 is developed by a toner contained in a developer of a developing unit 5 to be formed into a toner image. Then, the toner image formed and supported on the peripheral surface of the electrophotographic photosensitive member 1 is sequentially transferred to a transfer material (paper or the like) 7 with a transfer bias from a transferring unit (transfer roller or the like) 6. The transfer material 7 is taken out from a transfer material feed unit (not illustrated) in synchronous with the rotation of the electrophotographic photosensitive member 1, and fed to a portion (abutting portion) between the electrophotographic photosensitive member 1 and the transferring unit 6.

The transfer material 7 to which the toner image is transferred is separated from the peripheral surface of the electrophotographic photosensitive member 1 and introduced to a fixing unit 8, and is subjected to a treatment of fixing the toner image and then printed out outside the apparatus as an image-formed material (printed or copied material).

The surface of the electrophotographic photosensitive member 1, on which the toner image is transferred, is cleaned by a cleaning unit 9 so that a transfer residual toner is removed. Then, the electrophotographic photosensitive member 1 is subjected to a discharging treatment with pre-exposure light 10 from a pre-exposing unit (not illustrated), and thereafter repeatedly used for image forming. Herein, when the charging unit 3 is a contact charging unit using a charging roller or the like as illustrated in FIG. 1, pre-exposing is not necessarily required.

In addition, as the transferring unit, for example, a transferring unit of an intermediate transfer system in which a belt-shaped or drum-shaped intermediate transfer body is used may be adopted.

A plurality of constituent elements selected from the electrophotographic photosensitive member 1, the charging unit 3, the developing unit 5, the cleaning unit 9 and the like may be accommodated in a container to be integrally supported as a process cartridge. Such a process cartridge may be detachably attachable to the main body of the electrophotographic apparatus. In FIG. 1, the electrophotographic photosensitive member 1, and the charging unit 3, the developing unit 5 and the cleaning unit 9 are integrally supported to be formed into a cartridge, and thus set up to a process cartridge 11 detachably attachable to the main body of the electrophotographic apparatus by using a guiding unit 12 such as a rail provided in the main body of the electrophotographic apparatus.

EXAMPLES

Hereinafter, the present invention will be described in more detail with reference to specific Examples. Herein, "part(s)" in Examples means "part(s) by mass".

Example 1

An aluminum cylinder having a diameter of 30 mm, a length of 357.5 mm and a wall thickness of 1 mm was used as a support (conductive support).

Then, 100 parts of zinc oxide particles (specific surface area: 19 $m^2/g$, powder resistance: $4.7\times10^6$ Ω·cm) were stirred and mixed with 500 parts of toluene, 0.8 parts of a silane coupling agent was added thereto, and the resultant was stirred for 6 hours. Thereafter, toluene was distilled off under reduced pressure, and the resultant was heated and dried at 130° C. for 6 hours, providing zinc oxide particles surface-treated. As the silane coupling agent, KBM602 (compound name: N-2-(aminoethyl)-3-aminopropylmethyldimethoxysilane) produced by Shin-Etsu Chemical Co., Ltd. was used.

Then, 15 parts of a polyvinyl butyral resin (weight average molecular weight: 40000, product name: BM-1, produced by Sekisui Chemical Co., Ltd.) and 15 parts of a blocked isocyanate (product name: Sumijule 3175, produced by Sumika Bayer Urethane Co., Ltd.) were dissolved in a mixed solution of 73.5 parts of methyl ethyl ketone and 73.5 parts of 1-butanol. The zinc oxide particles surface-treated (80.8 parts) and 0.8 parts of 2,3,4-trihydroxybenzophenone (produced by Wako Pure Chemical Industries, Ltd.) were added to the resulting solution, and were dispersed by a sand mill apparatus using glass beads having a diameter of 0.8 mm at an atmosphere of 23±3° C. for 3 hours. After the dispersing, 0.01 parts of a silicone oil (product name: SH28PA, produced by Dow Corning Toray Co., Ltd.) and 5.6 parts of crosslinked poly(methyl methacrylate) (PMMA) particles (product name: TECHPOLYMER SSX-103, produced by Sekisui Plastics Co., Ltd., average primary particle size: 3.0 μm) were added for stirring, preparing an undercoat layer-coating liquid.

The undercoat layer-coating liquid was dip-applied on the aluminum cylinder to form a coat, and the resulting coat was dried at 160° C. for 40 minutes to form an undercoat layer having a thickness of 18 μm.

Then, a hydroxygallium phthalocyanine crystal (charge generation substance) of a crystal form having strong peaks at Bragg angles 2θ±0.2°, 7.4° and 28.2°, in CuKα characteristic X-ray diffraction was prepared. After 20 parts of the hydroxygallium phthalocyanine crystal, 0.2 parts of a calixarene compound represented by the following formula (A), 10 parts of a polyvinyl butyral resin (product name: S-Lec BX-1, produced by Sekisui Chemical Co., Ltd.) and 600 parts of cyclohexanone were dispersed by a sand mill apparatus using glass beads having a diameter of 1 mm for 4 hours, 700 parts of ethyl acetate was added thereto to prepare a charge generation layer-coating liquid. The charge generation layer-coating liquid was dip-applied on the undercoat layer to form a coat, and the resulting coat was heated and dried at a temperature of 80° C. for 15 minutes to thereby form a charge generation layer having a thickness of 0.17 μm.

(A)

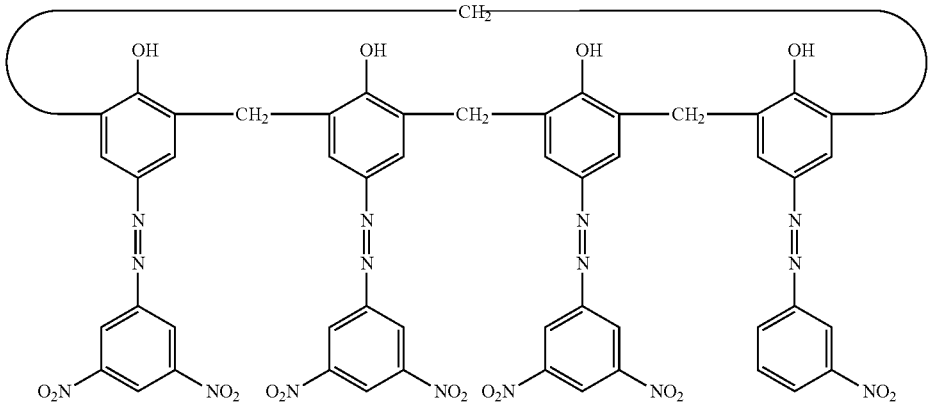

Then, 30 parts of a compound represented by the following structural formula (B) (charge transport substance), 60 parts of a compound represented by the following structural formula (C) (charge transport substance), 10 parts of a compound represented by the following structural formula (D), (B)

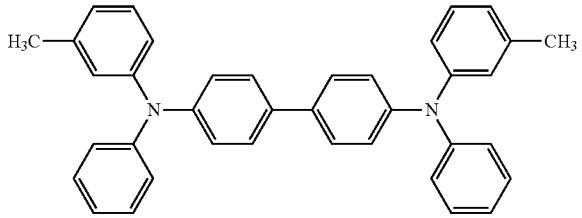

(C)

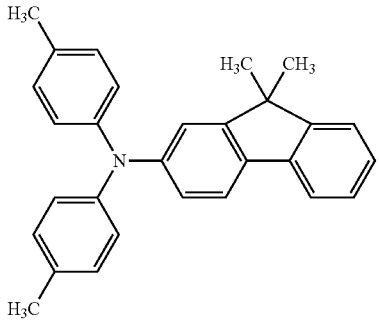

(D)

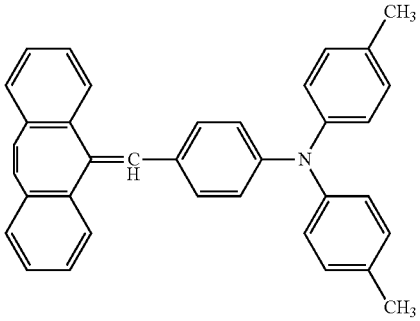

100 parts of a polycarbonate resin (product name: Iupilon Z400, produced by Mitsubishi Engineering-Plastics Corporation, bisphenol Z-type polycarbonate), and 0.02 parts of polycarbonate (viscosity average molecular weight Mv: 20000) having a structural unit represented by the following formula (E) and a structural unit represented by the following formula (F):

(E)

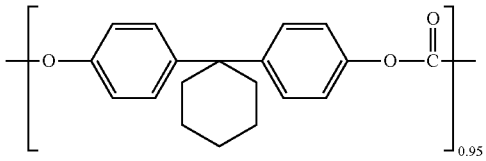

(F)

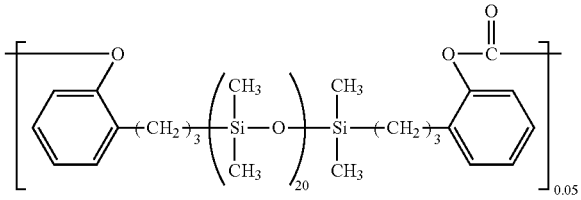

(in the formulae (E) and (F), numeral values 0.95 and 0.05 represent the molar ratios (copolymerization ratios) of the structural unit represented by the formula (E) and the structural unit represented by the formula (F), respectively.) were dissolved in a mixed solvent of 600 parts of mixed xylene and 200 parts of dimethoxymethane to thereby prepare a charge transport layer-coating liquid. The charge transport layer-coating liquid was dip-applied on the charge generation layer to form a coat, and the resulting coat was dried at 100° C. for 30 minutes to thereby form a charge transport layer having a thickness of 18 μm.

Then, 99 parts of the hole transporting compound represented by the exemplary compound (1-27), 1 part of a melamine compound (Nikalac MW-30 produced by Sanwa Chemical Co., Ltd.), 0.1 parts of p-toluenesulfonic acid as a catalyst, 35 parts of 1,1,2,2,3,3,4-heptafluorocyclopentane (product name: Zeorora H, produced by Zeon Corporation) and 35 parts of 1-propanol were mixed and well stirred. The resultant was subjected to filtration by a polyflon filter (product name: PF-060, manufactured by Advantec Toyo Kaisha, Ltd.) to prepare a surface layer-coating liquid.

The surface layer-coating liquid was applied on the charge transport layer to form a coat, and the coat was heat-treated at 160° C. for 1 hour for curing, to form a surface layer having a thickness of 5 μm as a protective layer.

In this way, an electrophotographic photosensitive member including the support, the undercoat layer, the charge generation layer, the charge transport layer and the surface layer (protective layer) was produced.

Evaluations

The electrophotographic photosensitive member produced was mounted on a cyan station in an electrophotographic apparatus (copier) (product name: iR-ADV C5051) altered, manufactured by Canon Inc., as an evaluation apparatus. Then, the initial potential at 30° C./80% RH, the potential after image formation for 1000 sheets, and the image (fine line) reproducibility were evaluated. With respect to the alteration of the apparatus, the process speed was set to 350 mm/sec.

First, an electrophotographic photosensitive member (for control) mounted on the electrophotographic apparatus was used, and the conditions of a charging apparatus and an exposure apparatus were set so that the initial dark portion potential (VD) and the initial light portion potential (VL) of the electrophotographic photosensitive member were −700V and −200V, respectively. Then, the initial dark portion potential (VD) and the initial light portion potential (VL) of the electrophotographic photosensitive member produced were measured. Image formation was performed for 1000 sheets under the conditions, and the dark portion potential (VD) and the light portion potential (VL) after the image formation for 1000 sheets were measured in the same manner.

The image reproducibility was evaluated as follows. First, the total discharge current in a charging step was set to 150 μA, and then a cassette heater in the apparatus was turned OFF. Thereafter, a test chart having an image rate of 5% was used to perform continuous image formation for 5000 sheets, and the sheets were left to stand for 3 days. Thereafter, an A4 horizontal 1 dot-1 space image of an output resolution of 600 dpi was formed, and the image density in the vicinity of the charging apparatus and the image reproducibility on the whole surface of the A4 image were evaluated as follows. Similarly, the total discharge current was set to 200 μA, and the image reproducibility was evaluated in the same manner.

A: No irregularities and scattering of dots (namely, no image deletion) were found in the vicinity of the charging apparatus, and the image (fine line) reproducibility was good.

B: Irregularities of dots were found in the vicinity of the charging apparatus when the image was enlarged and observed, but no scattering was found and the fine line reproducibility was good in other portion.

C: Irregularities and scattering of dots were generated in the vicinity of the charging apparatus when the image was enlarged and observed, but the fine line reproducibility was good in other portion.

D: Irregularities and scattering of dots were generated in the vicinity of the charging apparatus when the image was enlarged and observed, but the fine line reproducibility was good in other portion. However, a portion in which the fine line was dashed was generated at several points on the image.

E: White blanks were generated on the image in the vicinity of the charging apparatus, and the fine line reproducibility was poor in other portion.

F: White blanks were generated on the whole surface of the image and the fine line reproducibility was poor.

The results are shown in Table 1.

Examples 2 to 4

Each of electrophotographic photosensitive members was produced in the same manner as in Example 1 except that the contents of the hole transporting compound and the melamine compound were changed as shown in Table 1, and the evaluations were performed. The results are shown in Table 1.

Example 5

An electrophotographic photosensitive member was produced in the same manner as in Example 1 except that (1-8) was used as the hole transporting compound, and the evaluations were performed. The results are shown in Table 1.

Example 6

An electrophotographic photosensitive member was produced in the same manner as in Example 5 except that a guanamine compound (Nikalac BL-60 produced by Sanwa Chemical Co., Ltd.) was used instead of the melamine compound, and the evaluations were performed. The results are shown in Table 1.

Example 7

An electrophotographic photosensitive member was produced in the same manner as in Example 5 except that a blocked isocyanate (product name: Sumijule 3175, produced by Sumika Bayer Urethane Co., Ltd.) was used instead of the melamine compound, and the evaluations were performed. The results are shown in Table 1.

Example 8

An electrophotographic photosensitive member was produced in the same manner as in Example 5 except that a methylolated urea compound obtained by heating urea together with formaldehyde in the presence of a basic catalyst was used instead of the melamine compound, and the evaluations were performed. The results are shown in Table 1.

Examples 9 to 20

Each of electrophotographic photosensitive members was produced in the same manner as in Example 1 except that one shown in Table 1 was used as the hole transporting compound, and the evaluations were performed. The results are shown in Table 1.

Comparative Example 1

An electrophotographic photosensitive member was produced in the same manner as in Example 1 except that a compound represented by the following formula (6) was used as the hole transporting compound, and the evaluations were performed. The results are shown in Table 1.

(6)

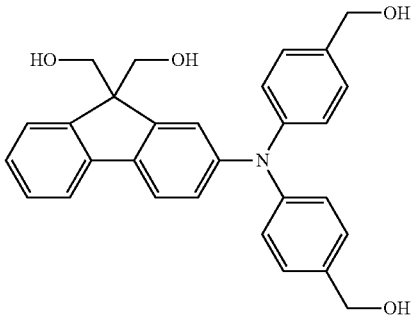

Comparative Example 2

An electrophotographic photosensitive member was produced in the same manner as in Example 1 except that a compound represented by the following structural formula (7) was used as the hole transporting compound, and the evaluations were performed. The results are shown in Table 1.

(7)

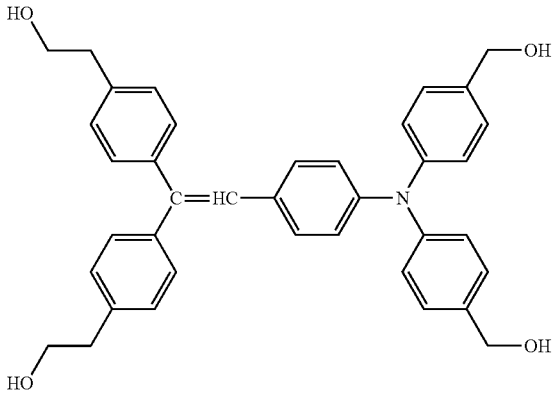

Comparative Example 3

An electrophotographic photosensitive member was produced in the same manner as in Comparative Example 1 except that 1 part of o-terphenyl (produced by Tokyo Chemical Industry Co., Ltd.) was further added to the components in Comparative Example 1, and the evaluations were performed. The results are shown in Table 1.

TABLE 1

| | Hole transporting compound having first reactive functional group | | Compound having second reactive functional group | | Initial potential (−V) | | Potential after endurance (−V) | | Image quality (image reproducibility) | |
|---|---|---|---|---|---|---|---|---|---|---|
| | Type of compound | Amount added | Type of compound | Amount added | VD | VL | VD | VL | 150 μA | 200 μA |
| Example 1 | I-27 | 99 parts | Melamine compound | 1 part | 700 | 199 | 700 | 200 | A | A |
| Example 2 | I-27 | 94 parts | Melamine compound | 6 parts | 700 | 205 | 700 | 215 | C | D |
| Example 3 | I-27 | 96 parts | Melamine compound | 4 parts | 700 | 203 | 699 | 211 | B | C |
| Example 4 | I-27 | 99 parts | Melamine compound | 0.1 part | 700 | 199 | 700 | 200 | B | B |
| Example 5 | I-8 | 99 parts | Melamine compound | 1 part | 700 | 198 | 698 | 202 | A | A |
| Example 6 | I-8 | 99 parts | Guanamine compound | 1 part | 700 | 200 | 698 | 205 | A | A |
| Example 7 | I-8 | 99 parts | Isocyanate compound | 1 part | 700 | 199 | 698 | 203 | A | A |
| Example 8 | I-8 | 99 parts | Urea compound | 1 part | 700 | 199 | 699 | 203 | B | B |
| Example 9 | I-83 | 99 parts | Melamine compound | 1 part | 700 | 200 | 699 | 204 | B | B |
| Example 10 | I-81 | 99 parts | Melamine compound | 1 part | 700 | 200 | 699 | 209 | C | C |
| Example 11 | I-85 | 99 parts | Melamine compound | 1 part | 700 | 199 | 697 | 203 | B | B |
| Example 12 | I-92 | 99 parts | Melamine compound | 1 part | 700 | 198 | 698 | 202 | B | B |
| Example 13 | I-96 | 99 parts | Melamine compound | 1 part | 700 | 198 | 697 | 202 | B | B |
| Example 14 | I-15 | 99 parts | Melamine compound | 1 part | 700 | 201 | 700 | 209 | B | B |
| Example 15 | I-46 | 99 parts | Melamine compound | 1 part | 700 | 198 | 698 | 202 | C | C |
| Example 16 | I-48 | 99 parts | Melamine compound | 1 parts | 700 | 199 | 699 | 204 | C | C |
| Example 17 | I-58 | 99 parts | Melamine compound | 1 parts | 700 | 200 | 697 | 204 | C | C |
| Example 18 | I-104 | 99 parts | Melamine compound | 1 parts | 700 | 203 | 697 | 210 | D | D |
| Example 19 | I-106 | 99 parts | Melamine compound | 1 parts | 700 | 205 | 700 | 218 | D | D |
| Example 20 | I-49 | 99 parts | Melamine compound | 1 parts | 700 | 212 | 700 | 230 | D | D |
| Comparative Example 1 | Amine-based CTM | 99 parts | Melamine compound | 1 parts | 700 | 199 | 700 | 200 | E | F |
| Comparative Example 2 | Amine-based CTM | 99 parts | Melamine compound | 1 parts | 700 | 200 | 699 | 202 | E | F |
| Comparative Example 3 | Amine-based CTM | 99 parts | Melamine compound | 1 parts | 700 | 207 | 699 | 248 | C | D |

As can be seen from Table 1, with respect to the evaluation results, the initial potential, the potential after endurance (potential after image formation for 1000 sheets), and the image (fine line) reproducibility were good in Examples. On the other hand, reduced image (fine line) reproducibility associated with image deletion was found in Comparative Examples 1 and 2, and was not at a satisfactory level. In Comparative Example 3, a good result was achieved with respect to the image deletion, but the VL potential after endurance was significantly increased relative to the initial VL potential, and the image density was found to be reduced after endurance and was not at a satisfactory level.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-045698, filed Mar. 7, 2013, and Japanese Patent Application No. 2014-032154, filed Feb. 21, 2014, which are hereby incorporated by reference herein in their entirety.

What is claimed is:

1. An electrophotographic photosensitive member comprising:

a support; and a photosensitive layer formed on the support, wherein a surface layer of the electrophotographic photosensitive member comprises a polymerized product of a composition comprising:

a hole transporting compound having a first reactive functional group; and a compound having a second reactive functional group reactable with the first reactive functional group, wherein the hole transporting compound is selected from the group consisting of a compound represented by the following formula (I-8), a compound represented by the following formula (I-9), a compound represented by the following formula (I-10), and a compound represented by the following formula (I-11):

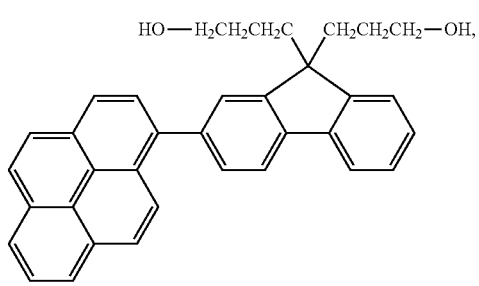

(I-8)

and wherein the compound having the second reactive functional group is a guanamine compound.

2. A process cartridge which integrally supports the electrophotographic photosensitive member according to claim 1, and at least one unit selected from the group consisting of a charging unit, a developing unit, a transferring unit and a cleaning unit, wherein the process cartridge is detachably attachable to a main body of an electrophotographic apparatus.

3. An electrophotographic apparatus comprising the electrophotographic photosensitive member according to claim 1, a charging unit, an exposing unit, a developing unit and a transferring unit.

4. The electrophotographic photosensitive member according to claim 1, wherein the hole transporting compound is the compound represented by the formula (I-10).

* * * * *